US010311881B2

(12) United States Patent
Briand et al.

(10) Patent No.: US 10,311,881 B2
(45) **Date of Patent: *Jun. 4, 2019**

(54) DETERMINING THE INTER-CHANNEL TIME DIFFERENCE OF A MULTI-CHANNEL AUDIO SIGNAL

(71) Applicant: Telefonaktiebolaget LM Ericsson (publ), Stockholm (SE)

(72) Inventors: Manuel Briand, Nice (FR); Tomas Jansson Toftgård, Uppsala (SE)

(73) Assignee: TELEFONAKTIEBOLAGET LM ERICSSON (PUBL), Stockholm (SE)

( * ) Notice: Subject to any disclaimer, the term of this patent is extended or adjusted under 35 U.S.C. 154(b) by 0 days.

This patent is subject to a terminal disclaimer.

(21) Appl. No.: 15/951,218

(22) Filed: Apr. 12, 2018

(65) Prior Publication Data

US 2018/0301154 A1 Oct. 18, 2018

Related U.S. Application Data

(63) Continuation of application No. 13/981,035, filed as application No. PCT/SE2011/050424 on Apr. 7, 2011, now Pat. No. 10,002,614.

(Continued)

(51) Int. Cl.
*G10L 19/008* (2013.01)
*G10L 25/06* (2013.01)

(52) U.S. Cl.
CPC ..... *G10L 19/008* (2013.01); *G10L 25/06* (2013.01)

(58) Field of Classification Search
None
See application file for complete search history.

(56) References Cited

U.S. PATENT DOCUMENTS 6,130,949 A * 10/2000 Aoki ..... G10H 3/125 381/94.3
10,002,614 B2 * 6/2018 Briand ..... G10L 19/008

(Continued)

FOREIGN PATENT DOCUMENTS

EP 1565036 A2 8/2005
WO 2010037426 A1 4/2010

OTHER PUBLICATIONS

Baumgarte, Frank et al., "Binaural Cue Coding—Part I: Psychoacoustic Fundamentals and Design Principles", Baumgarte, Frank. Binaural Cue Coding—Part I: Psychoacoustic Fundamentals and Design Principles, IEEE Transactions on Speech and Audio Processing, vol. 11, No. 6, Nov. 2003, pp. 1-11.

(Continued)

*Primary Examiner* — Michael N Opsasnick
(74) *Attorney, Agent, or Firm* — Murphy, Bilak & Homiller, PLLC

(57) ABSTRACT

Disclosed methods and apparatuses determine an inter-channel time difference of a multi-channel audio signal by determining a set of local maxima of a cross-correlation function involving at least two different channels of the multi-channel audio signal, for positive and negative time-lags and associating each local maximum with a corresponding time-lag. Local maximums for the positive and negative time-lags are selected from the set as respective positive and negative time-lag inter-channel correlation candidates. Processing also includes evaluating whether there is an energy-dominant channel, when the absolute value of a difference in amplitude between the inter-channel correlation candidates is smaller than a first threshold, and, when there is an energy-dominant-channel, identifying the sign of the inter-channel time difference and extracting a current value of the inter-channel time difference based on the time-lag corre- (Continued)

sponding to the positive or negative time-lag inter-channel correlation candidate.

21 Claims, 16 Drawing Sheets

Related U.S. Application Data

(60) Provisional application No. 61/439,028, filed on Feb. 3, 2011.

(56) References Cited

U.S. PATENT DOCUMENTS

2004/0039464 A1* 2/2004 Virolainen ..... G11B 20/00992 700/94
2006/0083385 A1 4/2006 Allamanche et al.
2009/0119111 A1* 5/2009 Goto ..... G10L 19/008 704/500
2009/0150161 A1* 6/2009 Faller ..... G10L 19/008 704/500
2009/0313028 A1 12/2009 Tammi et al.
2010/0125453 A1 5/2010 Gibbs et al.
2010/0142327 A1* 6/2010 Kepesi ..... G01S 3/786 367/124
2010/0223061 A1 9/2010 Ojanpera
2011/0046964 A1* 2/2011 Moon ..... G10L 19/008 704/500
2011/0085671 A1 4/2011 Gibbs
2011/0206209 A1* 8/2011 Ojala ..... G10L 19/008 381/1

OTHER PUBLICATIONS

Hyun, Dongil et al., "Robust Interchannel Correlation (ICC) Estimation Using Constant Interchannel Time Difference (ICTD) Compensation", Hyun, Dongil et al., Robust Interchannel Correlation (ICC) Estimation Using Constant Interchannel Time Difference (ICTD) Compensation, 137th Convention of Audio Engineering Society, Oct. 9-12, 2009, New York, NY.

Jansson, Tomas, "Stereo coding for the ITU-T G.719 codec", Tomas, Jansson. Stereo coding for the ITU-T G.719 codec, UPTEC F11 034, May 2011.

Tournery, Christophe et al., "Improved Time Delay Analysis/Synthesis for Parametric Stereo Audio Coding", Tournery, Christophe. Improved Time Delay Analysis/Synthesis for Parametric Stereo Audio Coding, 120th Convention of the Audio Engineering Society, Convention Paper 6753, Paris France, May 20-23, 2006.

* cited by examiner

L
R
Amplitude
sample
CCF
time-lag
ICTD=?
-119
61

Amplitude
L
R
sample
CCF
time-lag
30 samples
0.06
ICTD
-88
$\tau_0$

Amplitude
sample
CCF
time-lag
L
R
ICTD candidates
Positive ICTD candidate
Negative ICTD candidate
0.06

Amplitude
CCF
sample
time-lag
L
R
ICTD candidates
Positive ICTD candidate
Negative ICTD candidate
selected ICTD
selected ICTD Amplitude
sample
L
R
CCF
time-lag
ICTD candidates
Positive ICTD candidate
Negative ICTD candidate

*Fig. 12A*
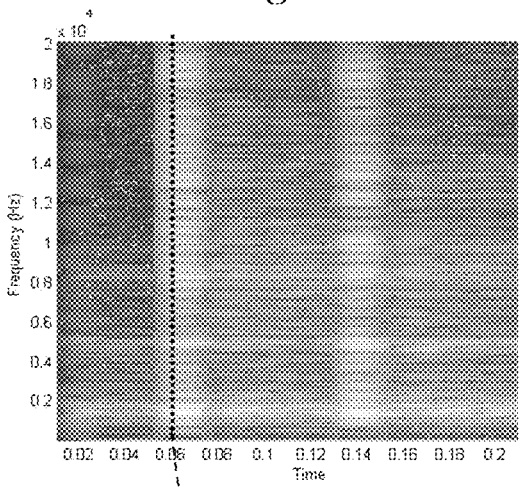
*Fig. 12B*
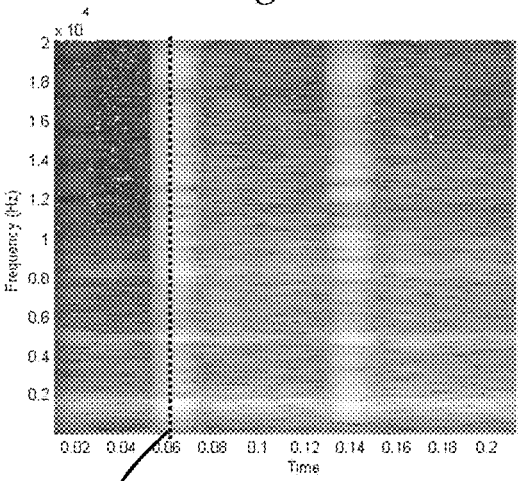
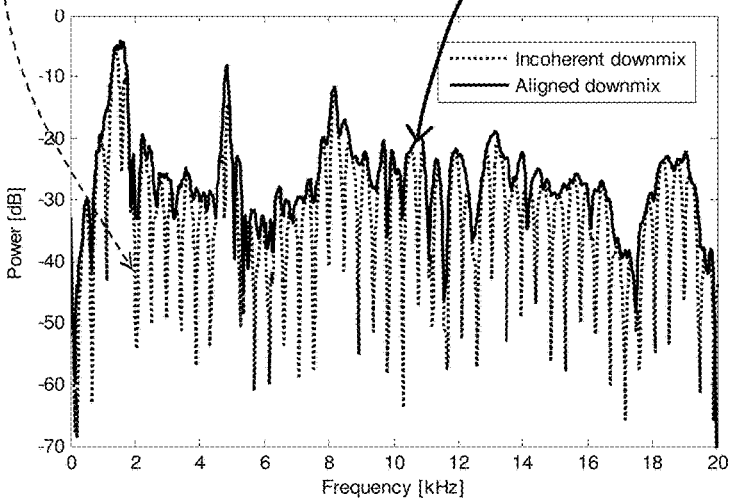
*Fig. 12C*

DETERMINING THE INTER-CHANNEL TIME DIFFERENCE OF A MULTI-CHANNEL AUDIO SIGNAL

RELATED APPLICATIONS

This application is a continuation of U.S. application Ser. No. 13/981,035 filed 22 Jul. 2013, which is a U.S. National Phase Application of PCT/SE2011/050424 filed 7 Apr. 2011, which claims benefit of U.S. Provisional Application No. 61/439,028 filed 3 Feb. 2011. The entire contents of each aforementioned application is incorporated herein by reference.

TECHNICAL FIELD

The present technology generally relates to the field of audio encoding and/or decoding and the issue of determining the inter-channel time difference of a multi-channel audio signal.

BACKGROUND

Spatial or 3D audio is a generic formulation which denotes various kinds of multi-channel audio signals. Depending on the capturing and rendering methods, the audio scene is represented by a spatial audio format. Typical spatial audio formats defined by the capturing method (microphones) are for example denoted as stereo, binaural, ambisonics, etc. Spatial audio rendering systems (headphones or loudspeakers) often denoted as surround systems are able to render spatial audio scenes with stereo (left and right channels 2.0) or more advanced multi-channel audio signals (2.1, 5.1, 7.1, etc.).

Recently developed technologies for the transmission and manipulation of such audio signals allow the end user to have an enhanced audio experience with higher spatial quality often resulting in a better intelligibility as well as an augmented reality. Spatial audio coding techniques generate a compact representation of spatial audio signals which is compatible with data rate constraint applications such as streaming over the internet for example. The transmission of spatial audio signals is however limited when the data rate constraint is too strong and therefore post-processing of the decoded audio channels is also used to enhanced the spatial audio playback. Commonly used techniques are for example able to blindly up-mix decoded mono or stereo signals into multi-channel audio (5.1 channels or more).

In order to efficiently render spatial audio scenes, these spatial audio coding and processing technologies make use of the spatial characteristics of the multi-channel audio signal.

In particular, the time and level differences between the channels of the spatial audio capture such as the Inter-Channel Time Difference ICTD and the Inter-Channel Level Difference ICLD are used to approximate the interaural cues such as the Interaural Time Difference ITD and Interaural Level Difference ILD which characterize our perception of sound in space. The term "cue" is used in the field of sound localization, and normally means parameter or descriptor. The human auditory system uses several cues for sound source localization, including time- and level differences between the ears, spectral information, as well as parameters of timing analysis, correlation analysis and pattern matching.

FIG. 1 illustrates the underlying difficulty of modeling spatial audio signals with a parametric approach. The Inter- Channel Time and Level Differences (ICTD and ICLD) are commonly used to model the directional components of multi-channel audio signals while the Inter-Channel Correlation ICC—that models the InterAural Cross-Correlation IACC—is used to characterize the width of the audio image. Inter-Channel parameters such as ICTD, ICLD and ICC are thus extracted from the audio channels in order to approximate the ITD, ILD and IACC which model our perception of sound in space. Since the ICTD and ICLD are only an approximation of what our auditory system is able to detect (ITD and ILD at the ear entrances), it is of high importance that the ICTD cue is relevant from a perceptual aspect.

FIG. 2 is a schematic block diagram showing parametric stereo encoding/decoding as an illustrative example of multi-channel audio encoding/decoding. The encoder 10 basically comprises a downmix unit 12, a mono encoder 14 and a parameters extraction unit 16. The decoder 20 basically comprises a mono decoder 22, a decorrelator 24 and a parametric synthesis unit 26. In this particular example, the stereo channels are down-mixed by the downmix unit 12 into a sum signal encoded by the mono encoder 14 and transmitted to the decoder 20, 22 as well as the spatial quantized (sub-band) parameters extracted by the parameters extraction unit 16 and quantized by the quantizer Q. The spatial parameters may be estimated based on the sub-band decomposition of the input frequency transforms for the left and the right channel. Each sub-band is normally defined according to a perceptual scale such as the Equivalent Rectangular Bandwidth—ERB. The decoder and the parametric synthesis unit 26 in particular performs a spatial synthesis (in the same sub-band domain) based on the decoded mono signal from the mono decoder 22, the quantized (sub-band) parameters transmitted from the encoder 10 and a decorrelated version of the mono signal generated by the decorrelator 24. The reconstruction of the stereo image is then controlled by the quantized sub-band parameters. Since these quantized sub-band parameters are meant to approximate the spatial or binaural cues, it is very important that the Inter-Channel parameters (ICTD, ICLD and ICC) are extracted and transmitted according to perceptual considerations so that the approximation is acceptable for the auditory system.

Stereo and multi-channel audio signals are often complex signals difficult to model especially when the environment is noisy or when various audio components of the mixtures overlap in time and frequency i.e. noisy speech, speech over music or simultaneous talkers, and so forth. Multi-channel audio signals made up of few sound components can also be difficult to model especially with the use of a parametric approach.

There is thus a general need for improved extraction or determination of the inter-channel time difference ICTD.

SUMMARY

It is a general object to provide a better way to determine or estimate an inter-channel time difference of a multi-channel audio signal having at least two channels.

It is also an object to provide improved audio encoding and/or audio decoding including such estimation of the inter-channel time difference.

These and other objects are met by embodiments as defined by the accompanying patent claims.

In a first aspect, there is provided a method for determining an inter-channel time difference of a multi-channel audio signal having at least two channels. A basic idea is to determine a set of local maxima of a cross-correlation function involving at least two different channels of the multi-channel audio signal for positive and negative time-lags, where each local maximum is associated with a corresponding time-lag. From the set of local maxima, a local maximum for positive time-lags is selected as a so-called positive time-lag inter-channel correlation candidate and a local maximum for negative time-lags is selected as a so-called negative time-lag inter-channel correlation candidate. The idea is then to evaluate, when the absolute value of a difference in amplitude between the inter-channel correlation candidates is smaller than a first threshold, whether there is an energy-dominant channel. When there is an energy-dominant-channel, the sign of the inter-channel time difference is identified and a current value of the inter-channel time difference is extracted based on either the time-lag corresponding to the positive time-lag inter-channel correlation candidate or the time-lag corresponding to the negative time-lag inter-channel correlation candidate.

In this way, ambiguities in inter-channel time difference can be eliminated, or at least reduced, and improved stability of the inter-channel time difference is thereby obtained.

In another aspect, there is provided an audio encoding method comprising such a method for determining an inter-channel time difference.

In yet another aspect, there is provided an audio decoding method comprising such a method for determining an inter-channel time difference.

In a related aspect, there is provided a device for determining an inter-channel time difference of a multi-channel audio signal having at least two channels. The device comprises a local maxima determiner configured to determine a set of local maxima of a cross-correlation function involving at least two different channels of the multi-channel audio signal for positive and negative time-lags, where each local maximum is associated with a corresponding time-lag. The device further comprises an inter-channel correlation candidate selector configured to select, from the set of local maxima, a local maximum for positive time-lags as a so-called positive time-lag inter-channel correlation candidate and a local maximum for negative time-lags as a so-called negative time-lag inter-channel correlation candidate. An evaluator is configured to evaluate, when the absolute value of a difference in amplitude between the inter-channel correlation candidates is smaller than a first threshold, whether there is an energy-dominant channel. An inter-channel time difference determiner is configured to identify, when there is an energy-dominant-channel, the sign of the inter-channel time difference and extract a current value of the inter-channel time difference based on either the time-lag corresponding to the positive time-lag inter-channel correlation candidate or the time-lag corresponding to the negative time-lag inter-channel correlation candidate.

In another aspect, there is provided an audio encoder comprising such a device for determining an inter-channel time difference.

In still another aspect, there is provided an audio decoder comprising such a device for determining an inter-channel time difference.

Other advantages offered by the present technology will be appreciated when reading the below description of embodiments.

BRIEF DESCRIPTION OF THE DRAWINGS

The embodiments, together with further objects and advantages thereof, may best be understood by making reference to the following description taken together with the accompanying drawings, in which:

FIGS. 12A-C are schematic diagrams illustrating an example of how alignment of the input channels according to the ICTD can avoid the comb-filtering effect and energy loss during the down-mix procedure.

DETAILED DESCRIPTION

Throughout the drawings, the same reference numbers are used for similar or corresponding elements.

A careful analysis made by the inventors has revealed that multi-channel audio signals can be difficult to model, especially with the use of a parametric approach, which can lead to ambiguities in the parameter extraction as described in the following.

The conventional parametric approach commonly described relies on the cross-correlation function (CCF here denoted as $r_{xy}$) which is a measure of similarity between two waveforms x[n] and y[n], and is generally defined in the time domain as:

$$r_{xy}[\tau] = \frac{1}{N}\sum_{n=0}^{N-1}(x[n] \times y[n+\tau]) \tag{1}$$

where $\tau$ is the time-lag parameter and N is the number of samples of the considered audio segment. The ICC is obtained as the maximum of the CCF which is normalized by the signal energies as follows:

$$ICC = \max_{\tau=ICTD}\left(\frac{r_{xy}[\tau]}{\sqrt{r_{xx}[0]r_{yy}[0]}}\right). \tag{2}$$

An equivalent estimation of the ICC is possible in the frequency domain by making use of the transforms X and Y (discrete frequency index k) to redefine the cross-correlation function as a function of the cross-spectrum according to:

$$r_{xy}[\tau] = \Re\left(DFT^{-1}\left(\frac{1}{N}X[k] \times Y^*[k]\right)\right) \tag{3}$$

where X[k] is the Discrete Fourier Transform (DFT) of the time domain signal x[n] such as:

$$X[k] = \sum_{n=0}^{N-1} x[n] \times e^{\frac{-2\pi i}{N}kn}, \quad k = 0, \ldots, N-1 \tag{4}$$

and the $DFT^{-1}(.)$ or IDFT(.) is the Inverse Discrete Fourier Transform of the spectrum X usually given by a standard IFFT for Inverse Fast Fourier Transform and * denotes the complex conjugate operation and $\Re$ denotes the real part function.

In equation (2), the time-lag $\tau$ maximizing the normalized cross-correlation is selected as the ICTD between the waveforms. According to equation (1), a positive (respectively negative) time-lag means that the channel x (respectively y) is delayed by a delay or an ICTD=$\tau$ compared to the channel y (respectively x). As discussed in the following, an ambiguity can occur between time-lags that can almost similarly maximize the CCF.

It should be understood that the present technology is not limited to any particular way of estimating the ICC. The study presented in [2] introduces the use of the ICTD to improve the estimation of the ICC. However, the current invention considers that the ICC is extracted according to any state-of-the-art method giving acceptable results. The ICC can be extracted either in the time or in the frequency domain using cross-correlation techniques.

Figures 3A, 3B, 3C:
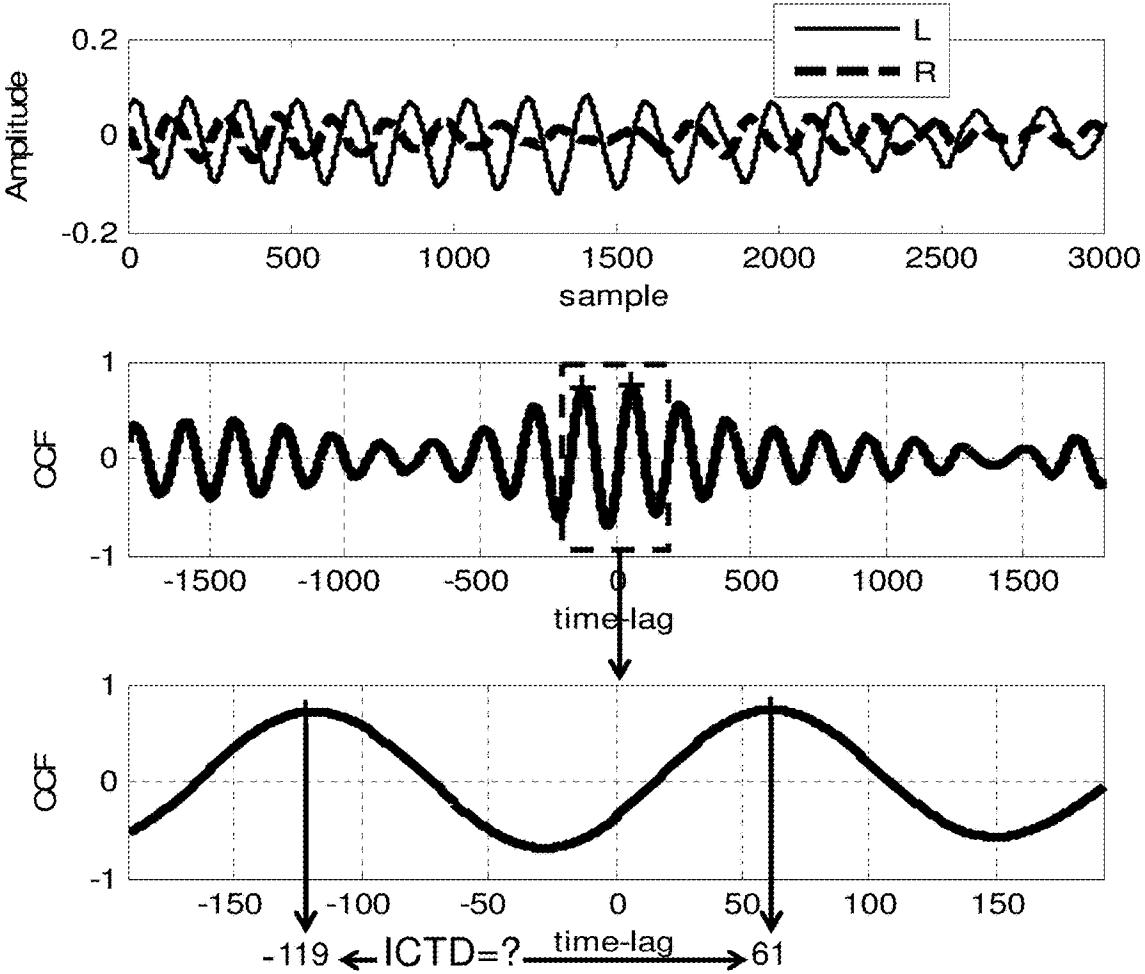
FIGS. 3A-C are schematic diagrams illustrating a problematic situation when the analyzed stereo channels are made up of tonal components.

FIGS. 3A-C are schematic diagrams illustrating a problematic situation when the analyzed stereo channels are made up of tonal components. In that case the CCF does not always contain a clear maximum when the signals are delayed in the stereo channels. Therefore an ambiguity lies in the stereo analysis because both a positive and a negative delay can be considered for extraction of the ICTD.

FIG. 3A is a schematic diagram illustrating an example of the waveforms of the left and right channels.

FIG. 3B is a schematic diagram illustrating an example of the Cross-Correlation Function computed from the left and right channels.

FIG. 3C is a schematic diagram illustrating an example of a zoom of the CCF of FIG. 3B for time-lags between −192 and 192 samples which is equivalent to consider an ICTD inside a range from −4 ms to 4 ms when the sampling frequency is 48000 Hz.

In this example, a voiced segment of a recorded speech signal (with an AB microphone setup) is considered in order to describe the problem with existing solutions based on the global maximum. These observations are also relevant for any kind of tonal signals such as a musical instrument for example and are to be further described in the following.

The analysis of tonal components leads to an ambiguity when trying to identify a global maximum in the CCF. Several local maxima might have similar amplitude (or very close) in the CCF and therefore some of them are potential candidates for being the global maximum that will allow a relevant extraction of the ICTD.

FIGS. 4A-D are schematic diagrams illustrating an example of this ambiguity for an artificial stereo signal generated from a single glockenspiel tone with a constant delay of 88 samples between the stereo channels. This shows that the global maximum identification does not always match the Inter-Channel Time Difference.

Figures 4A, 4B, 4C, 4D:
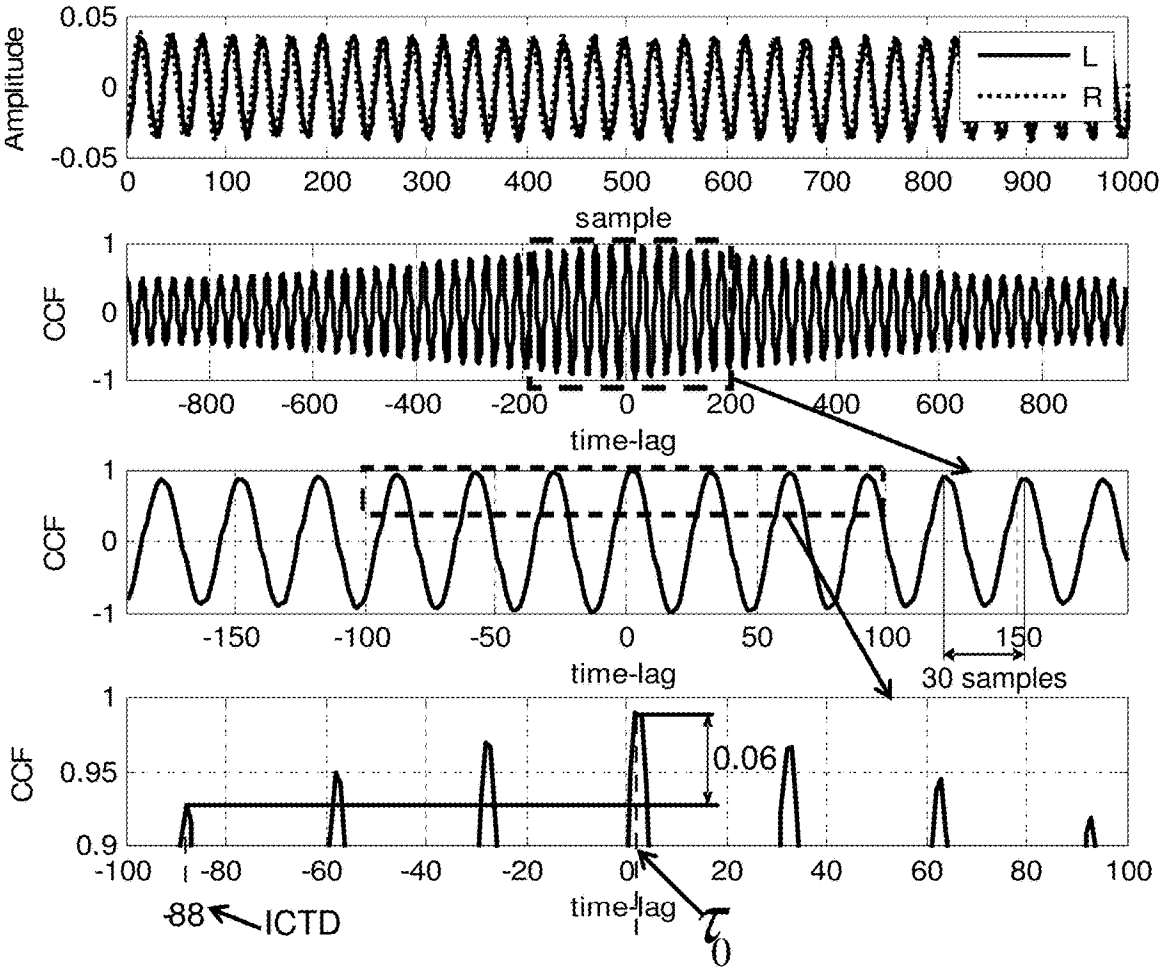
FIGS. 4A-D are schematic diagrams illustrating an example of the ambiguity for an artificial stereo signal.

FIG. 4A is a schematic diagram illustrating an example of the waveforms of the left and right channels.

FIG. 4B is a schematic diagram illustrating an example of the Cross-Correlation Function computed from the left and right channels.

FIG. 4C is a schematic diagram illustrating an example of a zoom of the CCF for time-lags between −192 and 192 samples. The time-lag difference between the local maxima is 30 samples.

FIG. 4D is a schematic diagram illustrating an example of a zoom of the CCF for time-lags between −100 and 100 samples. The time-lag $\tau_0$=2 is, for this particular signal, the time-lag of the global maximum of the CCF. The artificially injected ICTD corresponds to the local maximum at the time-lag $\tau$=−88 samples which is not the global maximum.

The time-lag difference $\Delta\tau$ between the local maxima is given by the frequency of the tone i.e. f=1.6 kHz, according to $\Delta\tau = f_s/f = 30$ where the sampling frequency $f_s$=48 kHz. For this particular stereo signal, the time-lags of each possible maxima of the CCF are defined by $\Delta\tau$ and $\tau_0$ according to:

$$\tau_m = m \times \Delta\tau + \tau_0 \tag{5}$$

$$\text{where} \begin{cases} \tau_0 = 2 \\ \Delta\tau = f_s / f = 30 \\ m = \{-6, , \ldots, 0, \ldots, 6\} \end{cases}$$

The time-lags have been limited to $\{-192, \ldots, +192\}$ samples due to a psycho-acoustical consideration related to the maximum acceptable ITD value, in this case it is considered varying in the range $\{-4, \ldots, +4\}$ ms. $\tau_0$ is the minimum time-lag that maximize the CCF. According to FIGS. 4A-D, the artificially introduced ICTD of 88 samples between the left and right channels corresponds to the local maximum of index m=−3 which is not the actual global maximum. As a result, the ICTD obtained using the conventional extraction method is not necessarily reliable in the case of tonal components (voiced speech, music instruments, and so forth).

Figure 1:
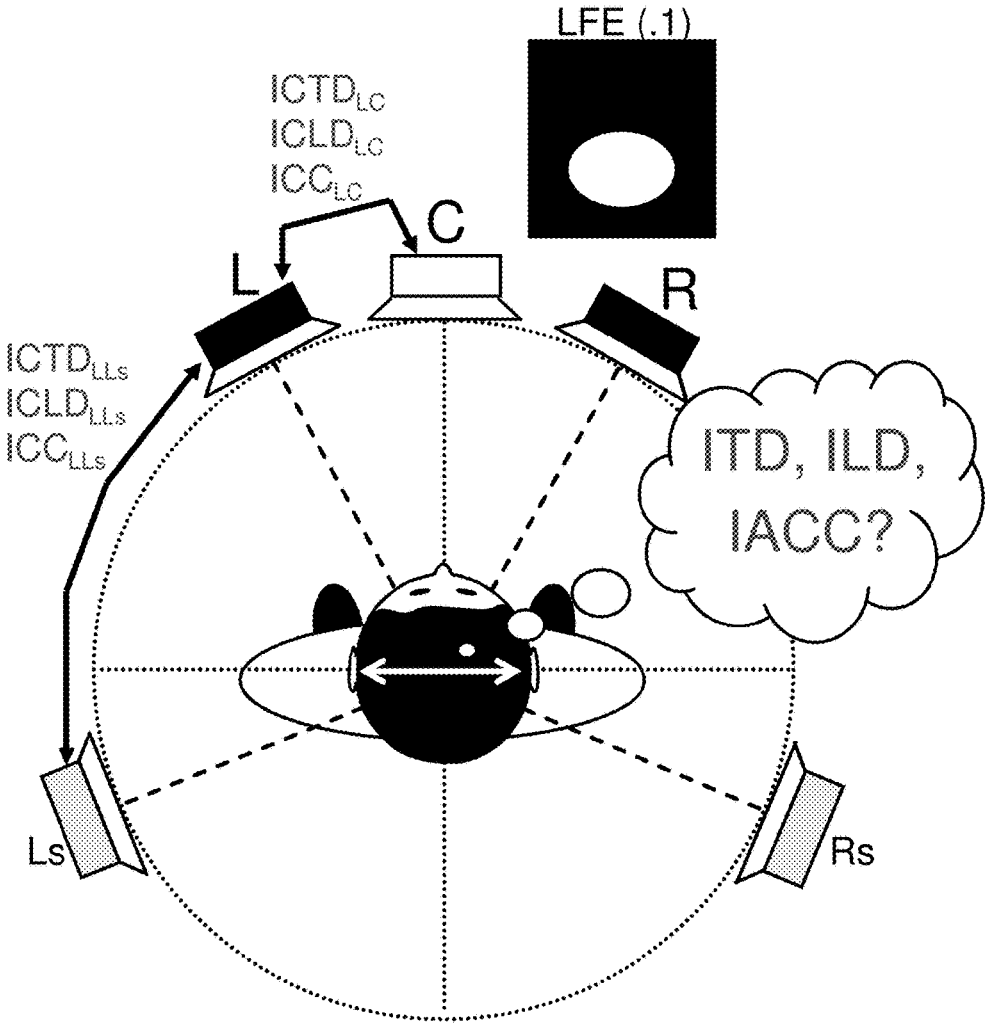
FIG. 1 is a schematic diagram illustrating an example of spatial audio playback with a 5.1 surround system.
Figure 2:
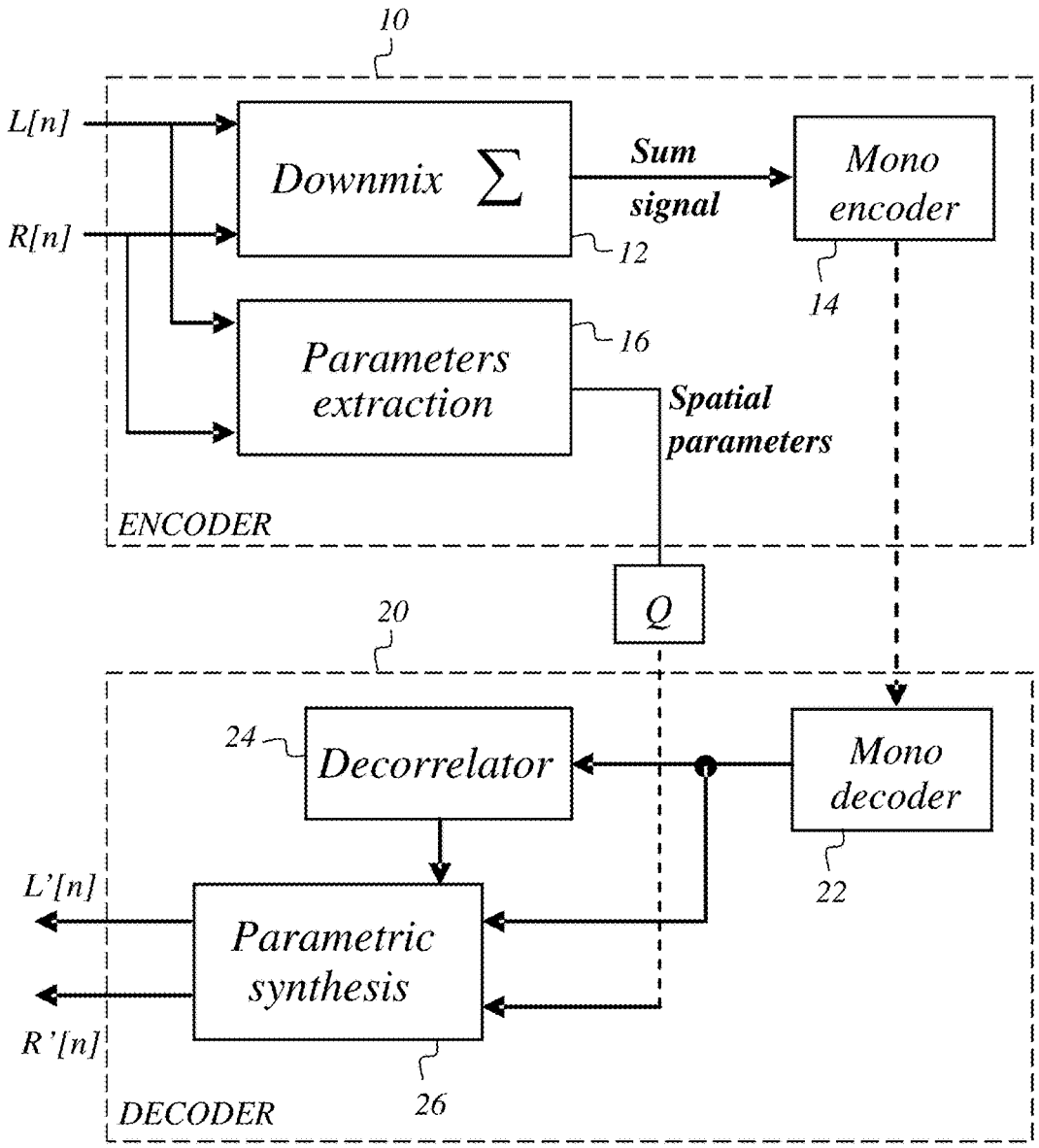
FIG. 2 is a schematic block diagram showing parametric stereo encoding/decoding as an illustrative example of multi-channel audio encoding/decoding.

This resulting ICTD is therefore ambiguous and can be used either as a forward or a backward shift which results in an unstable frame-by-frame parametric synthesis (as described by the decoder of FIG. 2). The overlapped segments coming out from the parametric (spatial) synthesis can become misaligned and generate some energy loss during the overlap-and-add synthesis. Moreover, the stereo image may become unstable due to possible switching from frame to frame between opposite delays if the tonal component is analyzed during several frames with this unresolved ambiguity.

A robust solution is needed to extract the exact delay between the channels of a multi-channel audio signal in order to efficiently model the localization of dominant sound sources even in presence of one or several tonal components.

Voice activity detection or more precisely the detection of tonal components within the stereo channels is used in [1] to adapt the update rate of the ICTD over time. The ICTD is extracted on a time-frequency grid i.e. using a sliding analysis window and a sub-band frequency decomposition. The ICTD is smoothed over time according to the combination of the tonality measure and the ICC cue. The algorithm allows for a strong smoothing of the ICTD when the signal is detected as tonal and an adaptive smoothing of the ICTD using the ICC as a forgetting factor when the tonality measure is low. The smoothing of the ICTD for exactly tonal components is questionable. Indeed, the smoothing of the ICTD makes the ICTD extraction very approximate and problematic especially when source(s) are moving in space. The spatial location of moving sources estimated as tonal components are therefore averaged and evolving very slowly. In other words, the algorithm described in [1] using a smoothing of the ICTD over time does not allow for a precise tracking of the ICTD when the signal characteristics evolve quickly in time.

Figures 5A, 5B, 5C:
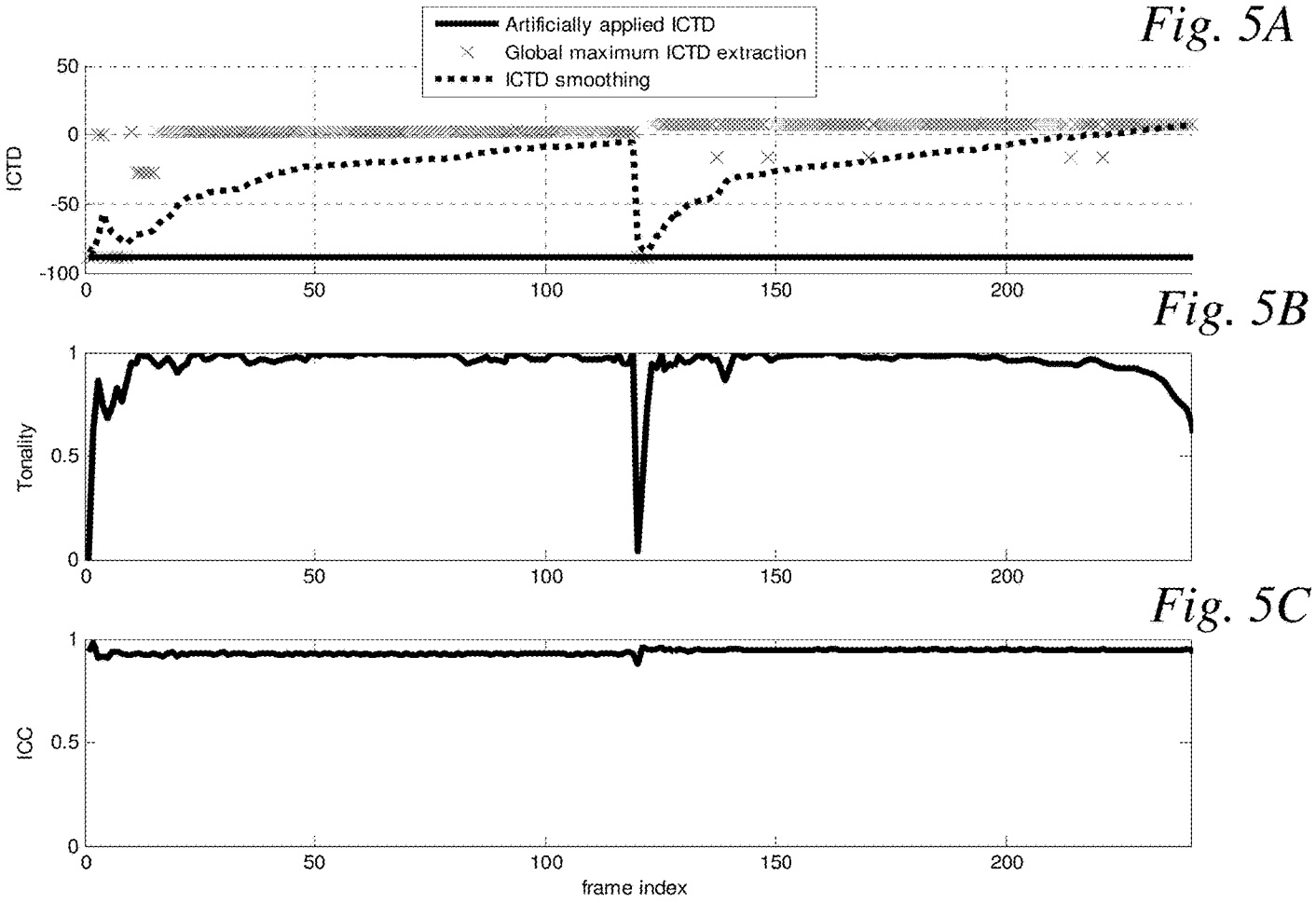
FIGS. 5A-C are schematic diagrams illustrating an example of the problems of a conventional solution.

FIGS. 5A-C are schematic diagrams illustrating the problems of the solution proposed in [1]. The analyzed stereo signal is artificially made up of two consecutive glockenspiel tones at 1.6 kHz and 2 kHz with a constant time delay of 88 samples between the channels.

FIG. 5A is a schematic diagram illustrating an example of the Inter-Channel Time Difference (ICTD value in samples) for two glockenspiel consecutive tones at 1.6 kHz and 2 kHz with an artificially applied time-delay of −88 samples between the channels. The ICTD obtained from the global maximum of the CCF is varying between frames due to the high tonality. The smoothed ICTD is slowly (respectively quickly) updated when the tonality is high (respectively low).

FIG. 5B is a schematic diagram illustrating an example of the tonality index varying from 0 to 1.

FIG. 5C is a schematic diagram illustrating an example of the extracted Inter-Channel Coherence or Correlation (ICC) used as forgetting factor in case of low tonality in the ICTD smoothing from the conventional algorithm [1].

The extracted ICTD from the global maximum of the CCF varies significantly between frames while it should be stable and constant over the analyzed frames. The smoothed ICTD is updated very slowly due to the high tonality of the signal. This results in an unstable description/modelization of the spatial image.

Figure 6:
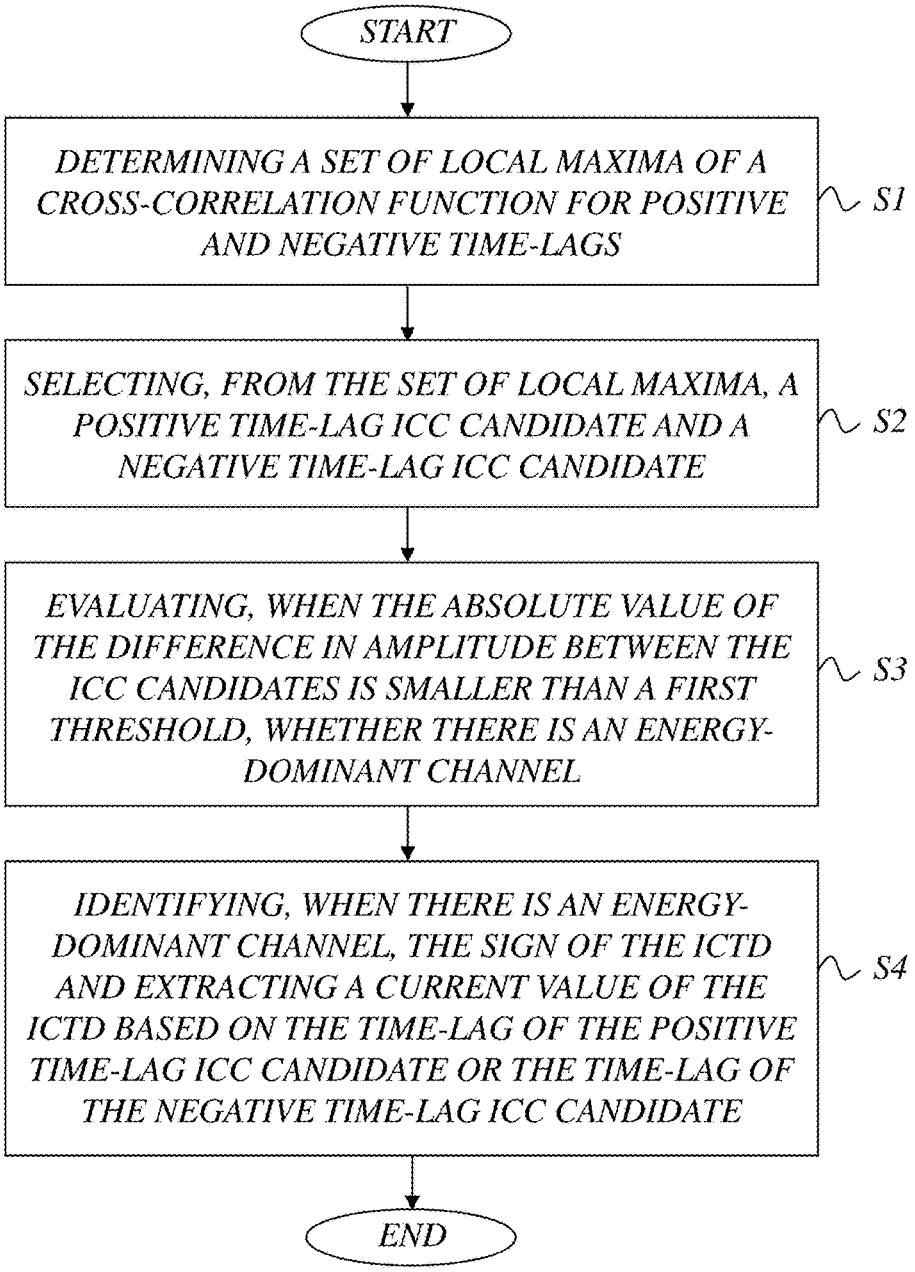
FIG. 6 is a schematic flow diagram illustrating an example of a basic method for determining an inter-channel time difference of a multi-channel audio signal having at least two channels according to an embodiment.

An example of a basic method for determining an inter-channel time difference of a multi-channel audio signal having at least two channels will now be described with reference to the flow diagram of FIG. 6.

It is assumed that a cross-correlation function of different channels of the multi-channel audio signal is defined for both positive and negative time-lags.

Step S1 includes determining a set of local maxima of a cross-correlation function involving at least two different channels of the multi-channel audio signal for positive and negative time-lags, where each local maximum is associated with a corresponding time-lag.

This could for example be a cross-correlation function of two or more different channels, normally a pair of channels, but could also be a cross-correlation function of different combinations of channels. More generally, this could be a cross-correlation function of a set of channel representations including at least a first representation of one or more channels and a second representation of one or more channels, as long as at least two different channels are involved overall.

Step S2 includes selecting, from the set of local maxima, a local maximum for positive time-lags as a so-called positive time-lag inter-channel correlation, ICC, candidate and a local maximum for negative time-lags as a so-called negative time-lag inter-channel correlation, ICC, candidate. Step S3 includes evaluating, when the absolute value of a difference in amplitude between the inter-channel correlation candidates is smaller than a first threshold, whether there is an energy-dominant channel among the considered channels. Step S4 includes identifying, when there is an energy-dominant-channel, the sign of the inter-channel time difference and extracting a current value of the inter-channel time difference, ICTD, based on either the time-lag corresponding to the positive time-lag inter-channel correlation candidate or the time-lag corresponding to the negative time-lag inter-channel correlation candidate.

In this way, ambiguities in inter-channel time difference can be eliminated, or at least significantly reduced, and improved stability of the inter-channel time difference is thereby obtained and this results in a better preservation of the localization of the dominant sound sources of interest.

It is common that one or more channel pairs of the multi-channel signal are considered, and there is normally a CCF for each pair of channels. More generally, there is a CCF for each considered set of channel representations.

As an example, the step of evaluating whether there is an energy-dominant channel includes evaluating whether an absolute value of the inter-channel level difference, ICLD, is larger than a second threshold.

Figure 16:
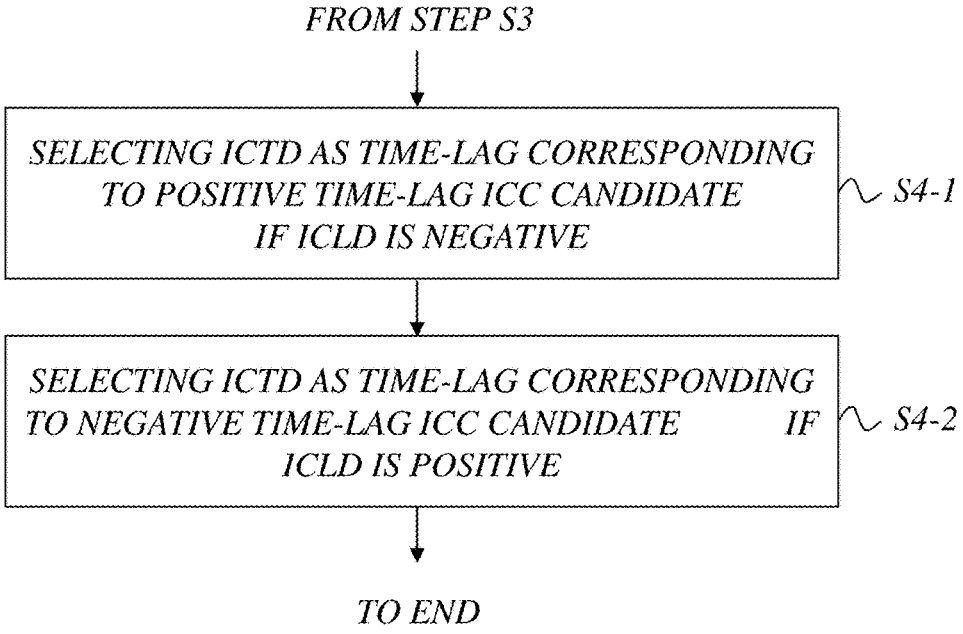
FIG. 16 is a schematic flow diagram illustrating an example of identifying the sign of the inter-channel time difference and extracting a current value of inter-channel time difference according to an embodiment.

If the absolute value of the inter-channel level difference is larger than a second threshold the step of identifying the sign of the inter-channel time difference and extracting/selecting a current value of inter-channel time difference may for example include (see FIG. 16):

- selecting in step S4-1 inter-channel time difference as the time-lag corresponding to the positive time-lag inter-channel correlation candidate if the inter-channel level difference is negative, and
- selecting in step S4-2 inter-channel time difference as the time-lag corresponding to the negative time-lag inter-channel correlation candidate if the inter-channel level difference is positive.

The positive time-lag inter-channel correlation candidate and the negative time-lag inter-channel correlation candidate may be denoted $\hat{C}^+$ and $\hat{C}^-$, respectively. These inter-channel correlation candidates $\hat{C}^+$ and $\hat{C}^-$ have corresponding time-lags denoted $\hat{\tau}^+$ and $\hat{\tau}^-$, respectively. In the example above, the positive time-lag $\hat{\tau}^+$ is selected if the inter-channel level difference ICLD is negative, and the negative time-lag $\hat{\tau}^-$ is selected if the inter-channel level difference ICLD is positive.

Figure 17:
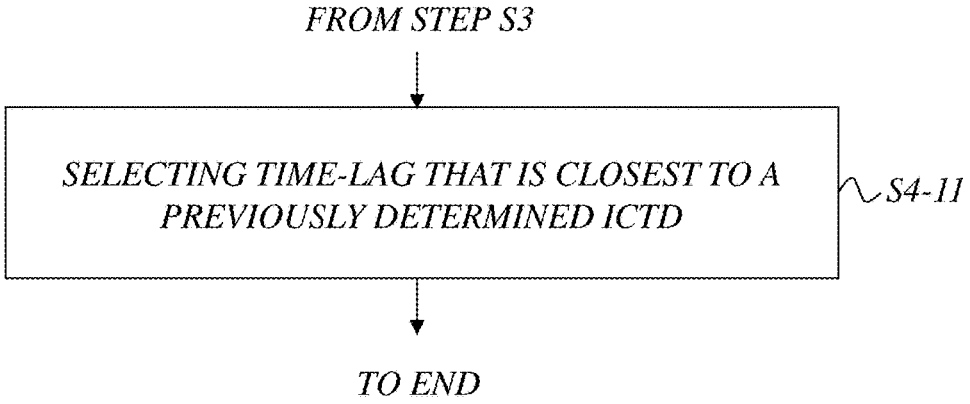
FIG. 17 is a schematic flow diagram illustrating another example of identifying the sign of the inter-channel time difference and extracting a current value of inter-channel time difference according to an embodiment.

If the absolute value of the inter-channel level difference is smaller than a second threshold the step of identifying the sign of the inter-channel time difference and extracting/selecting a current value of inter-channel time difference may for example include (see FIG. 17) selecting in step S4-11, from the time-lags corresponding to the inter-channel correlation candidates, the time-lag that is closest to a previously determined inter-channel time difference.

As will be understood by the skilled person, the time-lags corresponding to the inter-channel correlation candidates can be regarded as inter-channel time difference candidates.

The previously determined inter-channel time difference may for example be the inter-channel time difference determined for the previous frame if the processing is performed on a frame-by-frame basis. It should though be understood that the processing may alternatively be performed sample-by-sample. Similarly, processing in the frequency domain with several analysis sub-bands may also be used.

In other words, information indicating a dominant channel may be used to identify the relevant sign of the inter-channel time difference. Although it may be preferred to use the inter-channel level difference for this purpose, other alternatives include using the ratio between spectral peaks or any phase related information suitable to identify the sign (negative or positive) of the inter-channel time difference.

Figure 18:
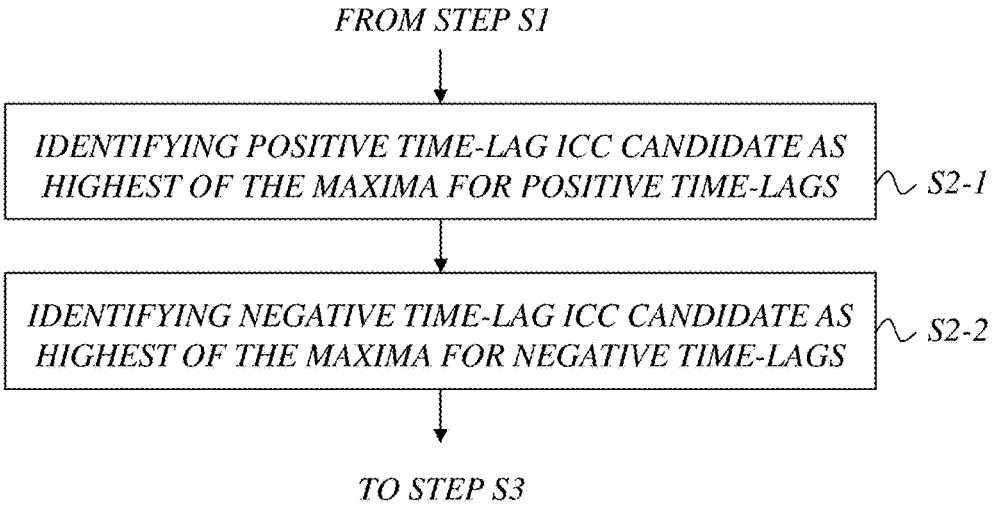
FIG. 18 is a schematic flow diagram illustrating an example of selecting a positive time-lag ICC candidate and a negative time-lag ICC candidate according to an embodiment.

As illustrated in the example of FIG. 18, the positive time-lag inter-channel correlation candidate may, by way of example, be identified in step S2-1 as the highest (largest amplitude) of the local maxima for positive time-lags, and the negative time-lag inter-channel correlation candidate may be identified in step S2-2 as the highest (largest amplitude) of the local maxima for negative time-lags.

Figure 19:
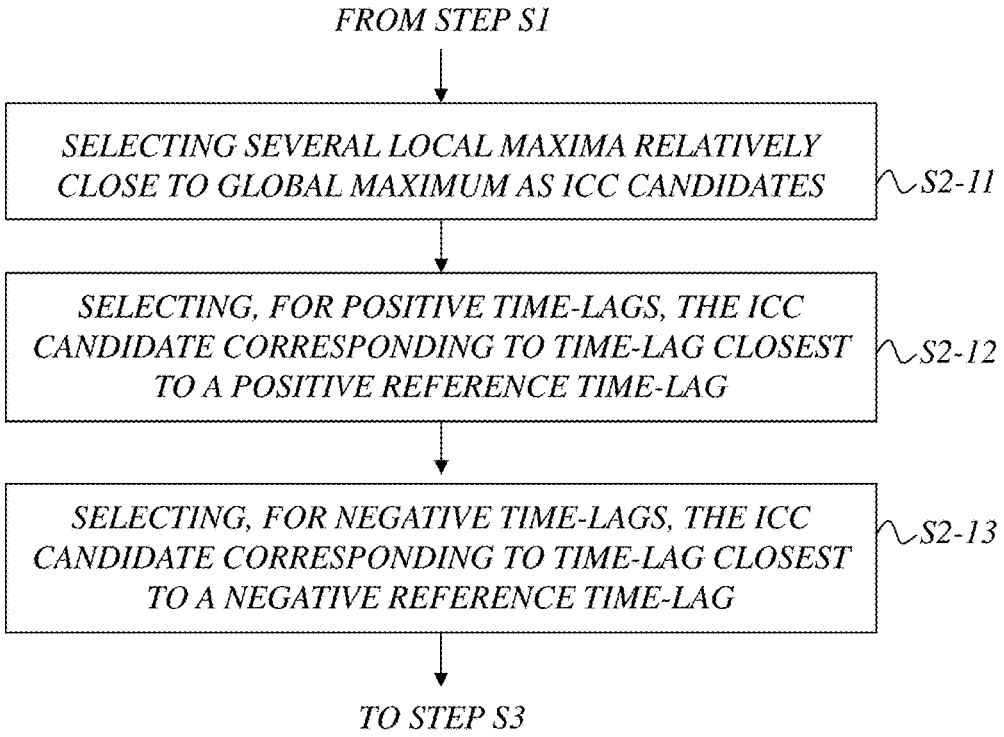
FIG. 19 is a schematic flow diagram illustrating another example of selecting a positive time-lag ICC candidate and a negative time-lag ICC candidate according to an embodiment.

Alternatively, as illustrated in the example of FIG. 19, several local maxima that are relatively close in amplitude to the global maximum are selected in step S2-11 as inter-channel correlation candidates, including local maxima for both positive and negative time-lags, and the selected local maxima are then processed to derive a positive time-lag inter-channel correlation candidate and a negative time-lag inter-channel correlation candidate. For example, for positive time-lags, the inter-channel correlation candidate corresponding to the time-lag that is closest to a positive reference time-lag is selected in step S2-12 as the positive time-lag inter-channel correlation candidate. Similarly, for negative time-lags, the inter-channel correlation candidate corresponding to the time-lag that is closest to a negative reference time-lag is selected in step S2-13 as the negative time-lag inter-channel correlation candidate.

The positive reference time-lag could be selected as the last extracted positive inter-channel time difference, and the negative reference time-lag could be selected as the last extracted negative inter-channel time difference.

In some sense, several possible ICTD are considered as a spatial cue relative to a directional component and a selection is made of the most relevant ICTD considering several maxima of the cross-correlation function (CCF) expressed in the time domain. It is normally beneficial to avoid too much approximation of the extracted ICTD by more exactly tracking delay between the channels in order to efficiently model the spatial positions of the dominant directional sources over time. Rather than smoothing the values of the ICTD over the analyzed frames, it is typically better to rely on a more advanced analysis of the CCF local maxima.

In another aspect, there is also provided an audio encoding method for encoding a multi-channel audio signal having at least two channels, wherein the audio encoding method comprises a method of determining an inter-channel time difference as described herein.

In yet another aspect, the improved ICTD determination (parameter extraction) can be implemented as a post-processing stage on the decoding side. Consequently, there is also provided an audio decoding method for reconstructing a multi-channel audio signal having at least two channels, wherein the audio decoding method comprises a method of determining an inter-channel time difference as described herein.

For a better understanding, the present technology will now be described in more detail with reference to non-limiting examples.

The present technology relies on an analysis of the CCF in order to perceptually extract relevant ICTD cues.

In a particular non-limiting example, steps of an illustrative method/algorithm can be summarized as follows:

1. The CCF which is a normalized function between −1 and 1, is defined along positive and negative time-lags.

2. Local maxima $L_i$ are determined for both positive and negative time-lags according to:

$$L_i = \left\{ r_{xy}[\tau] \;\middle|\; \begin{matrix} r_{xy}[\tau] > r_{xy}[\tau-1] \\ r_{xy}[\tau] > r_{xy}[\tau+1] \end{matrix} \right\}, \quad \tau \in \left[-\frac{N}{2}, \ldots, 0, \ldots \frac{N}{2}-1\right] \tag{6}$$

where i is a positive integer used to index the local maxima and N is the length of the analyzed speech/audio segment of index l.

In the following example, either the path A OR B is used, i.e. 1→2→3.A→4 OR 1→2→3.B→4→5, where either 4.1 OR 4.2 is selected.

3.A. Two candidates C, one for positive and one for negative time-lags, are identified directly from the set of local maxima according to:

$$\hat{C}^+ = \max(L_i | \tau_i \geq 0), i=1,2,$$

$$\hat{C}^- = \max(L_i | \tau_i < 0), i=1,2, \tag{7}$$

where $\tau_i$ is the time-lag of the corresponding local maxima $L_i$.

3.B. For all local maxima, several candidates C (j is the candidate index) are identified according to the definition of the global maximum:

$$G = \max(L_i), i=1,2, \tag{8}$$

and the following distance criterion:

$$C_j = \{L_i | |L_i - G| \leq \alpha \times T\}, i=1,2, \tag{9}$$

where α is set to, e.g., 2 but can possibly be dependent on the signal characteristics by using a tonality measure or the cross-correlation coefficient i.e. G, and T is a threshold defined further down in the algorithm.

Each identified candidate has an amplitude relatively close to G and a corresponding time-lag $\tau_j$. Two candidates are selected, one for positive and one for negative time-lags, according to:

$$\begin{cases} \hat{\tau}^+ = \arg\min_{\tau\in\{\tau_j\geq 0\}} |\tau - \hat{\tau}_*^+| \\ \hat{\tau}^- = \arg\min_{\tau\in\{\tau_j<0\}} |\tau - \hat{\tau}_*^-| \end{cases} \quad (10)$$

where the reference time-lag $\hat{\tau}_*^+$ (respectively $\hat{\tau}_*^-$) is the last extracted positive (respectively negative) ICTD. The corresponding $C_j$ are possible ICC candidates and denoted $\hat{C}^+$ and $\hat{C}^-$.

4. The sign of the ICTD is determined differently depending on the amplitude difference (distance) between the ICC candidates.

4.1. If the following condition is verified $|\hat{C}^+-\hat{C}^-|\leq T$, where T is set to, e.g., 0.1 but can be signal dependent for example relative to the value of G i.e. $T=\beta\times G$, there are two possibilities:

i. If the ICLD is able to indicate a dominant channel i.e. $\gamma<|ICLD|$ then the ICTD is set accordingly:

$$\begin{cases} ICTD = \hat{\tau}^+ \text{ if } ICLD < 0 \\ ICTD = \hat{\tau}^- \text{ if } ICLD > 0 \end{cases} \quad (11)$$

where $\gamma$ is set to a constant of 6 dB in this example and the ICLD is defined according to:

$$ICLD = 10\log_{10}\frac{\sum_{k=0}^{N-1} X[k]X^*[k]}{\sum_{k=0}^{N-1} Y[k]Y^*[k]} \quad (12)$$

ii. Otherwise when the ICLD is not able to indicate a dominant channel, the ICTD candidate that is closest to the ICTD of the previous frame is selected, i.e.:

$$ICTD[l] = \arg\min_{\tau\in\{\hat{\tau}^+,\hat{\tau}^-\}} |ICTD[l-1] - \tau| \quad (13)$$

Note that the frame index was implicit in the previous equations for clarity.

4.2. Otherwise when there is no sign ambiguity the ICTD is given by the time-lag corresponding to the maximum ICC candidate, i.e.:

$$\begin{cases} ICTD[l] = \hat{\tau}^+ & \text{if} \quad \hat{C}^+ > \hat{C}^- \\ ICTD[l] = \hat{\tau}^- & \text{otherwise} \end{cases} \quad (14)$$

5. The reference time-lags are updated accordingly:

$$\begin{cases} \hat{\tau}_*^+ = \hat{\tau}^+ & \text{if} \quad ICTD[l] \geq 0 \\ \hat{\tau}_*^- = \hat{\tau}^- & \text{otherwise} \end{cases} \quad (15)$$

Depending on the choice made for the step number 3, the step 3.A has the advantage of being less complex than the algorithm described in the step 3.B. However, there is typically no more consideration of previously extracted (positive and negative) ICTDs. In the following, the step 3.B is selected in order to better demonstrate the benefits of the algorithm.

The multiple maxima method/algorithm is described for a frame-by-frame analysis scheme (frame of index l) but can also be used and deliver similar behavior and results for a scheme in the frequency domain with several analysis sub-bands of index b. In that case, the CCF is defined for each frame and each sub-band being a subset of the spectrum defined in equation (3) i.e. $b=\{k, k_b<k<(k_{b+1})\}$ where $k_b$ are the boundaries of the frequency sub-bands. The algorithm is independently applied to each analyzed sub-band according to equation (1) and the corresponding $r_{xy}[l,b]$. This way the improved ICTD is also extraction in the time-frequency domain defined by the grid of indices l and b. The condition 4.1.i. is valid in case of a full-band analysis but should normally be modified to $\gamma=\infty$ to increase the performance of the algorithm with a sub-band analysis.

In order to illustrate the behavior of the method/algorithm an artificial stereo signal made up of a glockenspiel tone with a constant delay of 88 samples between the stereo channels is analyzed.

Figures 7A, 7B, 7C:
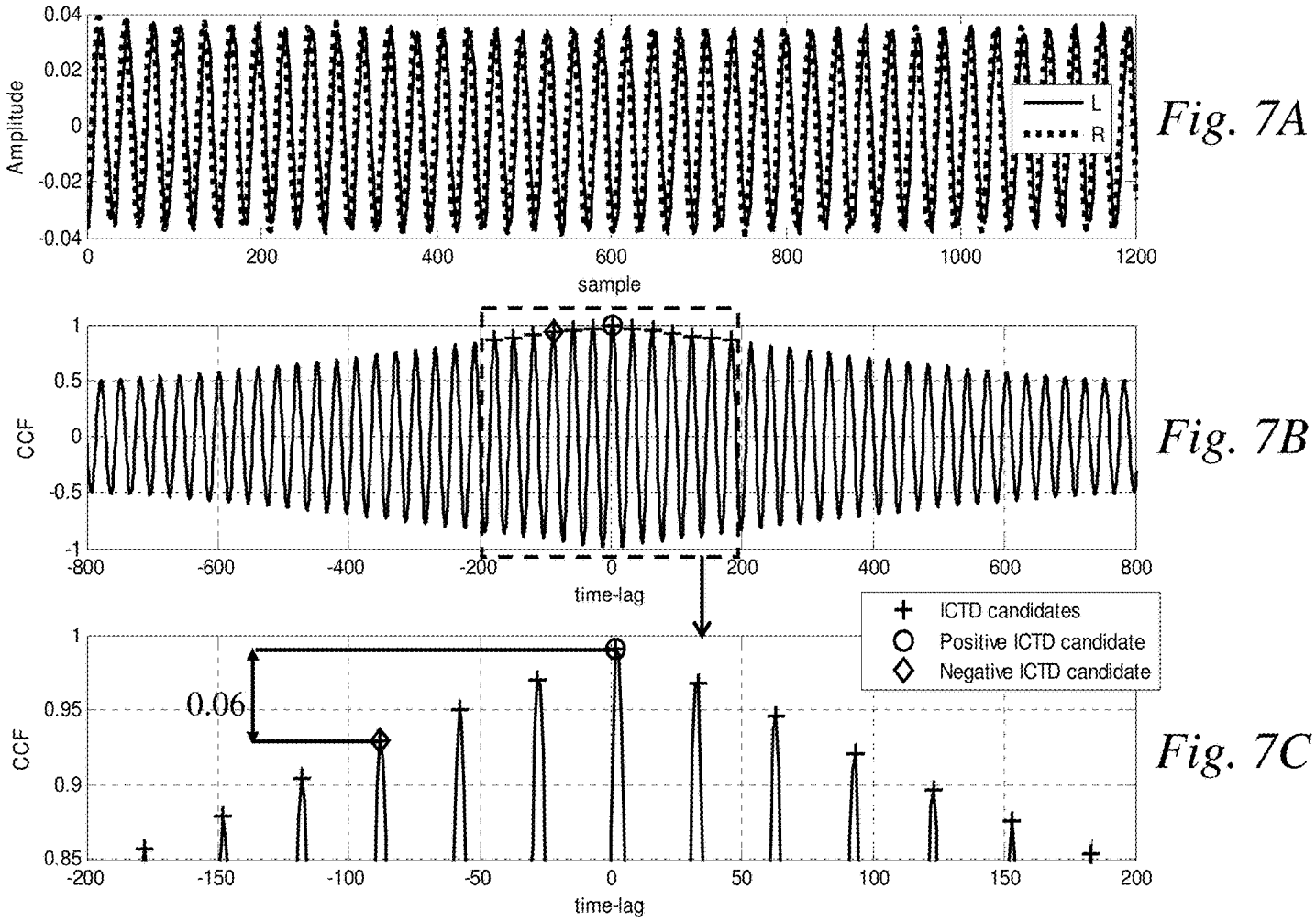
FIGS. 7A-C are schematic diagrams illustrating an example of ICTD candidates derived from the method/algorithm according to an embodiment.

FIGS. 7A-C are schematic diagrams illustrating an example of ICTD candidates derived from the method/algorithm according to an embodiment. More interestingly this particular analysis demonstrates that the global maximum is not related to the ICTD between the stereo channels. However, the algorithm identifies a positive ICTD candidate and a negative ICTD candidate that are further compared to select the relevant ICTD that was originally applied to the stereo channels.

FIG. 7A is a schematic diagram illustrating an example of the waveforms of the left and right channels of a stereo signal made up of a glockenspiel tone at 1.6 kHz delayed in the left channel by 88 samples.

FIG. 7B is a schematic diagram illustrating an example of the CCF computed from the left and right channels.

In this example, the method/algorithm considers multiple maxima in the range of {−192, . . . , 192} sample time-lags that are equivalent to ICTD varying in the range {−4, . . . , 4} ms in the case of a sampling frequency of 48 kHz.

FIG. 7C is a schematic diagram illustrating an example of a zoom of the CCF for time-lags between −192 and 192 samples. In this example, one positive ICTD candidate and one negative ICTD candidate are selected as the closest values relative to the last selected positive and negative ICTD, respectively.

In the following, an example of improved ICTD extraction based on multiple CCF maxima and the ICLD between the original channels will be described. The preservation of the localization for voiced frames in the case of a female speech signal recorded with an AB microphone setup will be illustrated.

Figures 8A, 8B, 8C, 9A, 9B, 9C:
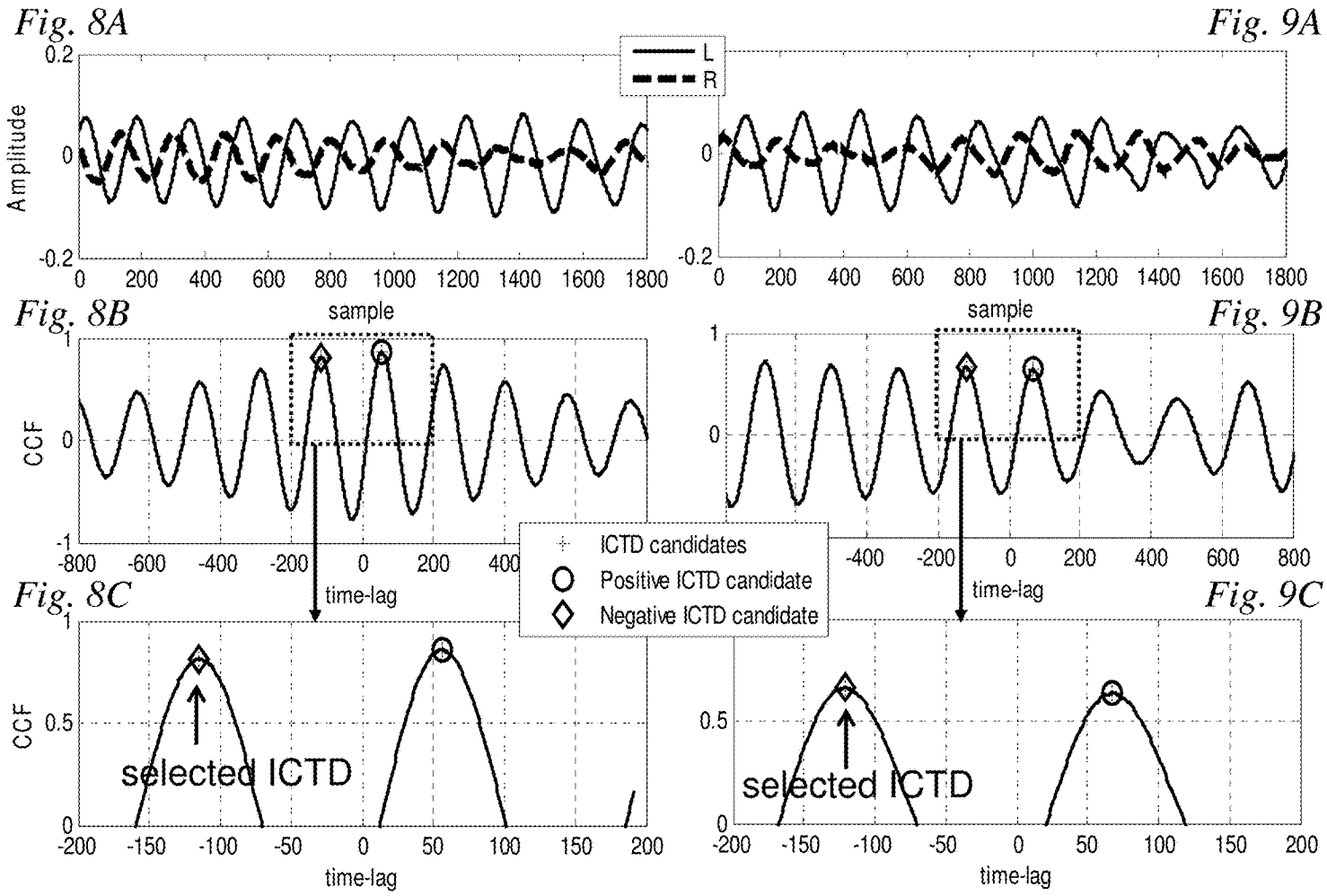
FIGS. 8A-C are schematic diagrams illustrating an example for an analyzed frame of index 1.
FIGS. 9A-C are schematic diagrams illustrating an example for an analyzed frame of index 1+1.

FIGS. 8A-C are schematic diagrams illustrating an example for an analyzed frame of index 1.

FIGS. 9A-C are schematic diagrams illustrating an example for an analyzed frame of index 1+1.

FIG. 8A is a schematic diagram illustrating an example of the waveforms of left and right channels with an ICLD=8 dB.

FIG. 8B is a schematic diagram illustrating an example of the CCF computed from the left and right channels.

FIG. 8C is a schematic diagram illustrating an example of a zoom of the CCF for perceptually relevant time-lags between −4 and 4 ms or equally −192 to 192 samples with a sampling frequency of 48 kHz.

The positive ICTD candidate is in this case the global maximum of the CCF in the range of the relevant time-lags but it has not been selected by the method/algorithm since the ICLD>6 dB. In this example, this means that the left channel is dominant and therefore a positive ICTD is not acceptable.

FIG. 9A is a schematic diagram illustrating an example of the waveforms of left and right channels with an ICLD=9 dB.

FIG. 9B is a schematic diagram illustrating an example of the CCF computed from the left and right channels.

FIG. 9C is a schematic diagram illustrating an example of a zoom of the CCF for perceptually relevant time-lags between −4 and 4 ms or equally −192 to 192 samples with a sampling frequency of 48 kHz.

The negative ICTD candidate has been selected by the method/algorithm as the relevant ICTD and in this specific case it is the global maximum of the CCF in the relevant range of time-lags.

The ICTD extracted by the algorithm is constant over two frames even if the global maximum of the CCF has changed. In this example, the method/algorithm makes use of another spatial cue—ICLD (e.g. see step 4.1.i)—in order to identify a dominant channel when the ICLD is larger than 6 dB.

Another ambiguity in the ICTD extraction may occur when two overlapped sources with equivalent energy are analyzed within the same time-frequency tile, i.e. the same frame and same frequency sub-band.

Figures 10A, 10B, 10C:
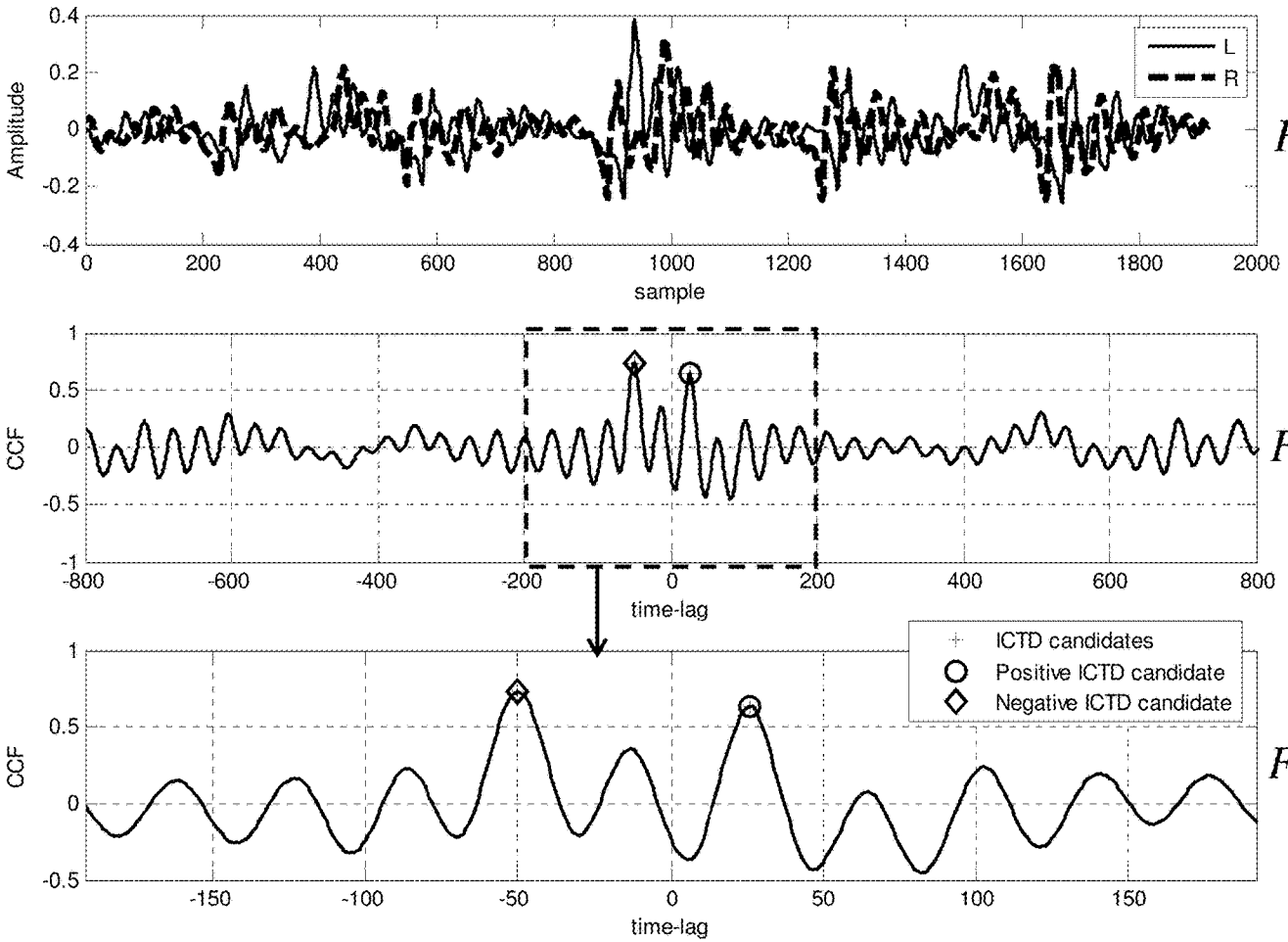
FIGS. 10A-C are schematic diagrams illustrating an ambiguous ICTD in the case of two different delays in the same analyzed segment solved by the method/algorithm according to an embodiment which allows the preservation of the localization in the spatial image.

FIGS. 10A-C are schematic diagrams illustrating an ambiguous ICTD in the case of two different delays in the same analyzed segment solved by the method/algorithm according to an embodiment which allows the preservation of the localization in the spatial image. The analysis is performed for an artificial stereo signal made up of two speakers with different spatial localizations generated by applying two different ICTD.

FIG. 10A is a schematic diagram illustrating an example of the waveforms of the left and right channels.

FIG. 10B is a schematic diagram illustrating an example of the CCF computed from the left and right channels for a double talker speech signal with controlled ICTD of −50 and 27 samples artificially applied to the original sources.

FIG. 10C is a schematic diagram illustrating an example of a zoom of the CCF for time-lags between −192 and 192 samples.

In this example, the positive and negative ICTD candidates are identified as −50 and 26 samples. The negative ICTD is selected for the currently analyzed frame since this particular time-lag maximizes the CCF and is coherent with the ICTD extracted in the previous frame.

The step 4.1.ii is able to preserve the localization even though there is an ambiguity by selecting the ICTD candidate that is closest to the previously extracted ICTD.

Figure 11:
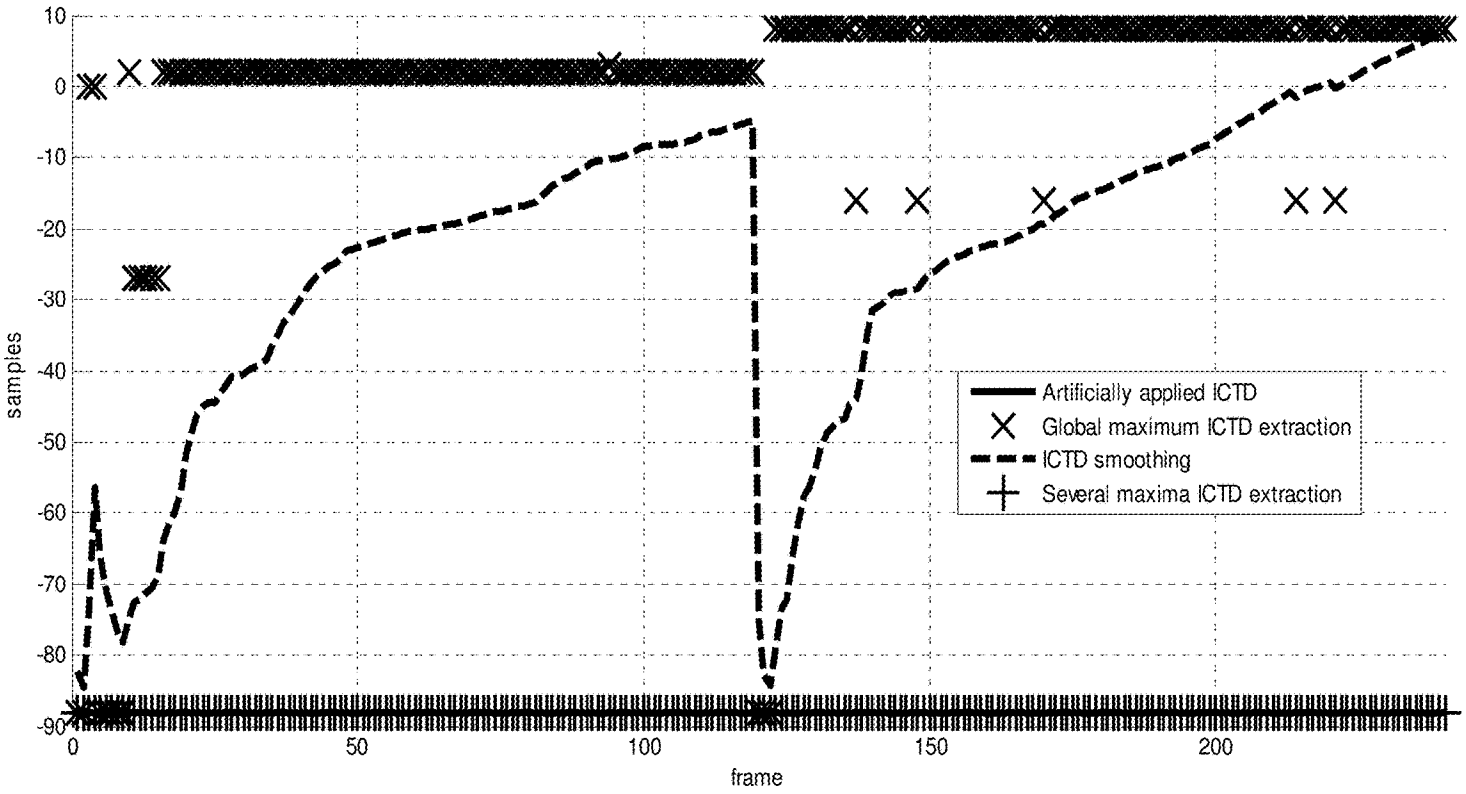
FIG. 11 is a schematic diagram illustrating an example of improved ICTD extraction of tonal components.

To further illustrate the improvement of the multiple maxima method/algorithm compared to the state-of-the-art, reference can also be made to FIG. 11.

FIG. 11 is a schematic diagram illustrating an example of improved ICTD extraction of tonal components. In this example, the ICTD is extracted over frames for a stereo sample of two glockenspiel tones at 1.6 kHz and 2 kHz with an artificially applied time difference of −88 samples between the channels, in similarity to the example of FIGS. 5A-C. The new ICTD extraction method/algorithm considering several maxima of the CCF stabilizes the ICTD compared to the existing state-of-the-art algorithms.

The ICTD extraction is clearly improved since the ICTD from the several maxima ICTD extraction perfectly follows the artificially applied time difference between the channels. In particular the ICTD smoothing used by the conventional technique [1] is not able to preserve the localization of the directional source when the tonality is high.

In the context of multi-channel audio rendering, the down- or up-mix are very common processing techniques. The current algorithm allows the generation of coherent down-mix signal post alignment, i.e. time delay—ICTD—compensation.

FIGS. 12A-C are schematic diagrams illustrating an example of how alignment of the input channels according to the ICTD can avoid the comb-filtering effect and energy loss during the down-mix procedure, e.g. from 2-to-1 channel or more generally speaking from N-to-M channels where (N≥2) and (M≤2). Both full-band (in the time-domain) and sub-band (frequency-domain) alignments are possible according to implementation considerations.

FIG. 12A is a schematic diagram illustrating an example of a spectrogram of the down-mix of incoherent stereo channels, where the comb-filtering effect can be observed as horizontal lines.

FIG. 12B is a schematic diagram illustrating an example of a spectrogram of the aligned down-mix, i.e. sum of the aligned/coherent stereo channels.

FIG. 12C is a schematic diagram illustrating an example of a power spectrum of both down-mix signals. There is a large comb-filtering in case the channels are not aligned which is equivalent to energy losses in the mono down-mix.

When the ICTD is used for spatial synthesis purposes the current method allows a coherent synthesis with a stable spatial image. The spatial position of the reconstructed source is not floating in space since no smoothing of the ICTD is used. Indeed the proposed algorithm stabilizes the spatial image by means of previously extracted ICTD, currently extracted ICLD and an optimized search over the multiple maxima of the CCF in order to precisely extract a relevant ICTD from the current CCF. The present technology allows a more precise localization estimate of the dominant source within each frequency sub-band due to a better extraction of both the ICTD and ICLD cues. The stabilization of the ICTD from channels with characterized coherence has been presented and illustrated above. The same benefit occurs for the extraction of the ICLD when the channels are aligned in time.

In a related aspect, there is provided a device for determining an inter-channel time difference of a multi-channel audio signal having at least two channels.

Figure 13:
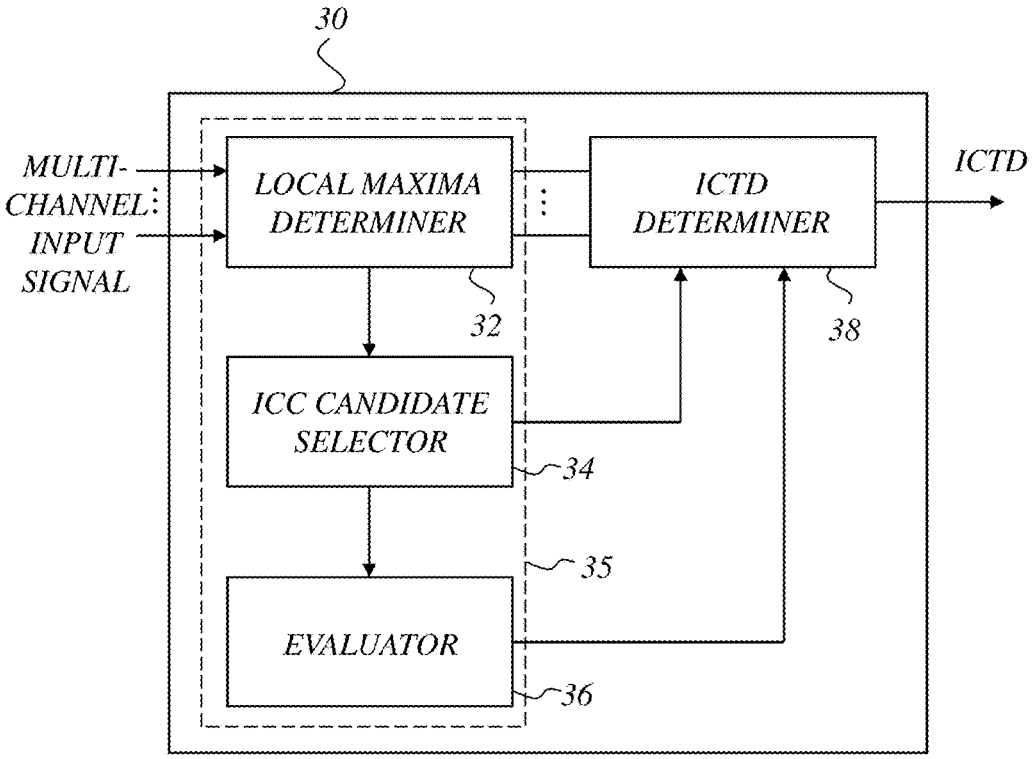
FIG. 13 is a schematic block diagram illustrating an example of a device for determining an inter-channel time difference of a multi-channel audio signal having at least two channels according to an embodiment.

With reference to the block diagram of FIG. 13 it can be seen that the device 30 comprises a local maxima determiner 32, an inter-channel correlation, ICC, candidate selector 34, an evaluator 36 and an inter-channel time difference, ICTD, determiner 38.

The local maxima determiner 32 is configured to determine a set of local maxima of a cross-correlation function of different channels of the multi-channel input signal for positive and negative time-lags, where each local maximum is associated with a corresponding time-lag.

This could for example be a cross-correlation function of two or more different channels, normally a pair of channels, but could also be a cross-correlation function of different combinations of channels. More generally, this could be a cross-correlation function of a set of channel representations including at least a first representation of one or more channels and a second representation of one or more channels, as long as at least two different channels are involved overall.

The inter-channel correlation, ICC, candidate selector 34 is configured to select, from the set of local maxima, a local maximum for positive time-lags as a so-called positive time-lag inter-channel correlation candidate and a local maximum for negative time-lags as a so-called negative time-lag inter-channel correlation candidate.

The evaluator 36 is configured to evaluate, when the absolute value of a difference in amplitude between the inter-channel correlation candidates is smaller than a first threshold, whether there is an energy-dominant channel.

The inter-channel time difference, ICTD, determiner 38, also referred to as an ICTD extractor, is configured to identify, when there is an energy-dominant-channel, the relevant sign of the inter-channel time difference and extract a current value of the inter-channel time difference based on either the time-lag corresponding to the positive time-lag inter-channel correlation candidate or the time-lag corresponding to the negative time-lag inter-channel correlation candidate.

The ICTD determiner 38 may use information from the local maxima determiner 32 and/or the ICC candidate selector 34 or the original multi-channel input signal when determining ICTD values corresponding to the ICC candidates.

It is common that one or more channel pairs of the multi-channel signal are considered, and there is normally a CCF for each pair of channels. More generally, there is a CCF for each considered set of channel representations.

As an example, the evaluator 36 may be configured to evaluate whether an absolute value of the inter-channel level difference is larger than a second threshold.

The inter-channel time difference determiner 38 may for example be configured to extract a current value of inter-channel time difference according to the following procedure, provided that the absolute value of the inter-channel level difference is larger than a second threshold:

selecting inter-channel time difference as the time-lag corresponding to the positive time-lag inter-channel correlation candidate if the inter-channel level difference is negative, and selecting inter-channel time difference as the time-lag corresponding to the negative time-lag inter-channel correlation candidate if the inter-channel level difference is positive.

The inter-channel time difference determiner 38 may for example be configured to extract a current value of inter-channel time difference by selecting, from the time-lags corresponding to the inter-channel correlation candidates, the time-lag that is closest to a previously determined inter-channel time difference, provided that the absolute value of the inter-channel level difference is smaller than a second threshold.

The device can implement any of the previously described variations of the method for determining an inter-channel time difference of a multi-channel audio signal.

For example, the inter-channel correlation candidate selector 34 may be configured to identify the positive time-lag inter-channel correlation candidate as the highest of the local maxima for positive time-lags, and identify the negative time-lag inter-channel correlation candidate as the highest of the local maxima for negative time-lags.

Alternatively, the inter-channel correlation candidate selector 34 is configured to select several local maxima that are relatively close in amplitude to the global maximum as inter-channel correlation candidates, including local maxima for both positive and negative time-lags, and process the selected local maxima to derive a positive time-lag inter-channel correlation candidate and a negative time-lag inter-channel correlation candidate. For example, the inter-channel correlation candidate selector 34 may be configured to select, for positive time-lags, the inter-channel correlation candidate corresponding to the time-lag that is closest to a positive reference time-lag as the positive time-lag inter-channel correlation candidate, and select, for negative time-lags, the inter-channel correlation candidate corresponding to the time-lag that is closest to a negative reference time-lag as the negative time-lag inter-channel correlation candidate.

In this aspect, the inter-channel correlation candidate selector 36 may for example use the last extracted positive inter-channel time difference as the positive reference time-lag and the last extracted negative inter-channel time difference as the negative reference time-lag.

The local maxima determiner 32, the ICC candidate selector 34 and the evaluator 36 may be considered as a multiple maxima processor 35.

In another aspect, there is provided an audio encoder configured to operate on signal representations of a set of input channels of a multi-channel audio signal having at least two channels, wherein the audio encoder comprises a device configured to determine an inter-channel time difference as described herein. By way of example, the device for determining an inter-channel time difference of FIG. 13 may be included in the audio encoder of FIG. 2. It should be understood that the present technology can be used with any multi-channel encoder.

In still another aspect, there is provided an audio decoder for reconstructing a multi-channel audio signal having at least two channels, wherein the audio decoder comprises a device configured to determine an inter-channel time difference as described herein. By way of example, the device for determining an inter-channel time difference of FIG. 13 may be included in the audio decoder of FIG. 2. It should be understood that the present technology can be used with any multi-channel decoder.

Figure 14:
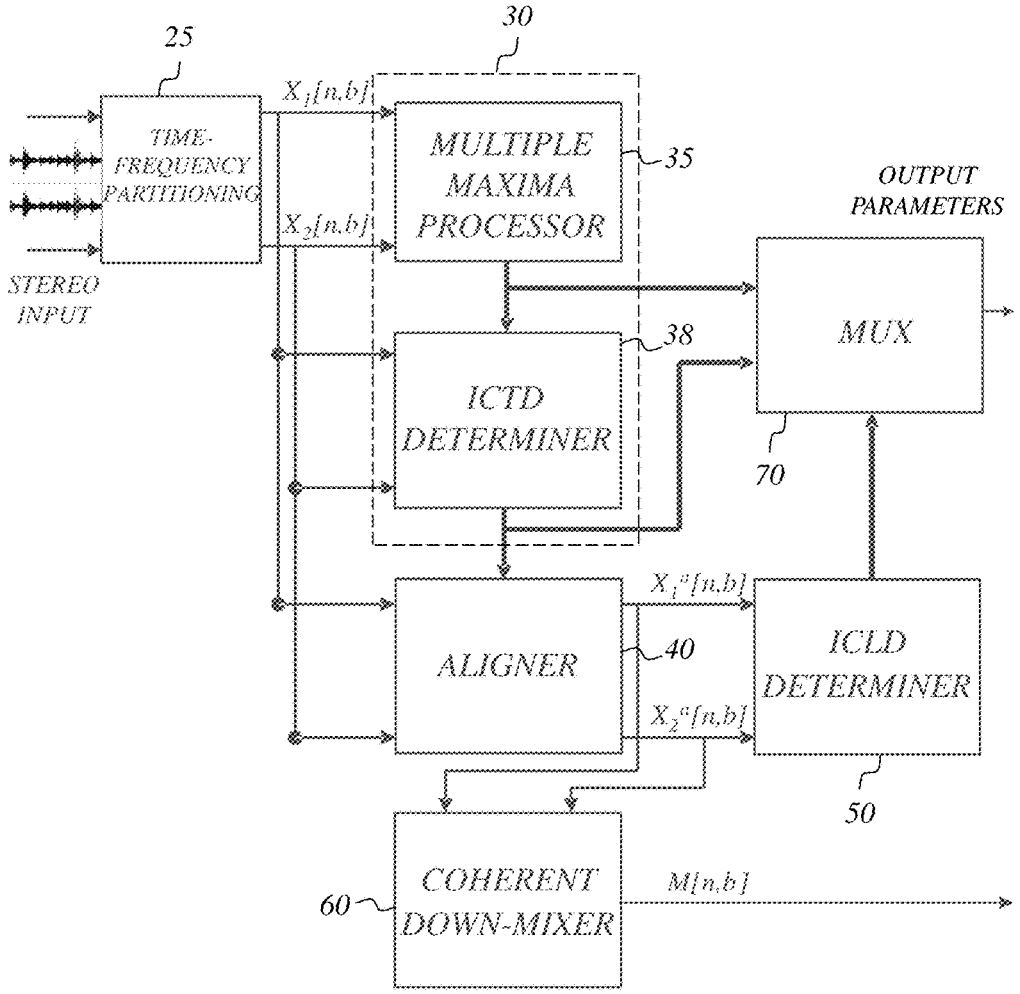
FIG. 14 is a schematic block diagram illustrating an example of parameter adaptation in the exemplary case of stereo audio according to an embodiment.

FIG. 14 is a schematic block diagram illustrating an example of parameter adaptation in the exemplary case of stereo audio according to an embodiment. The present technology is not limited to stereo audio, but is generally applicable to multi-channel audio involving two or more channels. The overall encoder includes an optional time-frequency partitioning unit 25, a so-called multiple maxima processor 35, an ICTD determiner 38, an optional aligner 40, an optional ICLD determiner 50, a coherent down-mixer 60 and a MUX 70.

The multiple maxima processor 35 is configured to determine a set of local maxima, select ICC candidates and evaluate the absolute value of a difference in amplitude between the inter-channel correlation candidates.

The multiple maxima processor 35 of FIG. 14 basically corresponds to the local maxima determiner 32, the ICC candidate selector 34 and the evaluator 36 of FIG. 13.

The multiple maxima processor 35 and the ICTD determiner 38 basically correspond to the device 30 for determining inter-channel time difference.

The ICTD determiner 38 is configured to identify the relevant sign of the inter-channel time difference ICTD and extract a current value of the inter-channel time difference in any of the above-described ways. The extracted parameters are forwarded to the multiplexer MUX 70 for transfer as output parameters to the decoding side.

The aligner 40 performs alignment of the input channels according to the relevant ICTD to avoid the comb-filtering effect and energy loss during the down-mix procedure by the coherent down-mixer 60. The aligned channels may then be used as input to the ICLD determiner 50 to extract a relevant ICLD, which is forwarded to the MUX 70 for transfer as part of the output parameters to the decoding side.

It will be appreciated that the methods and devices described above can be combined and re-arranged in a variety of ways, and that the methods can be performed by one or more suitably programmed or configured digital signal processors and other known electronic circuits (e.g. discrete logic gates interconnected to perform a specialized function, or application-specific integrated circuits).

Many aspects of the present technology are described in terms of sequences of actions that can be performed by, for example, elements of a programmable computer system.

User equipment embodying the present technology includes, for example, mobile telephones, pagers, headsets, laptop computers and other mobile terminals, and the like.

The steps, functions, procedures and/or blocks described above may be implemented in hardware using any conventional technology, such as discrete circuit or integrated circuit technology, including both general-purpose electronic circuitry and application-specific circuitry.

Alternatively, at least some of the steps, functions, procedures and/or blocks described above may be implemented in software for execution by a suitable computer or processing device such as a microprocessor, Digital Signal Processor (DSP) and/or any suitable programmable logic device such as a Field Programmable Gate Array (FPGA) device and a Programmable Logic Controller (PLC) device.

It should also be understood that it may be possible to re-use the general processing capabilities of any device in which the present technology is implemented. It may also be possible to re-use existing software, e.g. by reprogramming of the existing software or by adding new software components.

Figure 15:
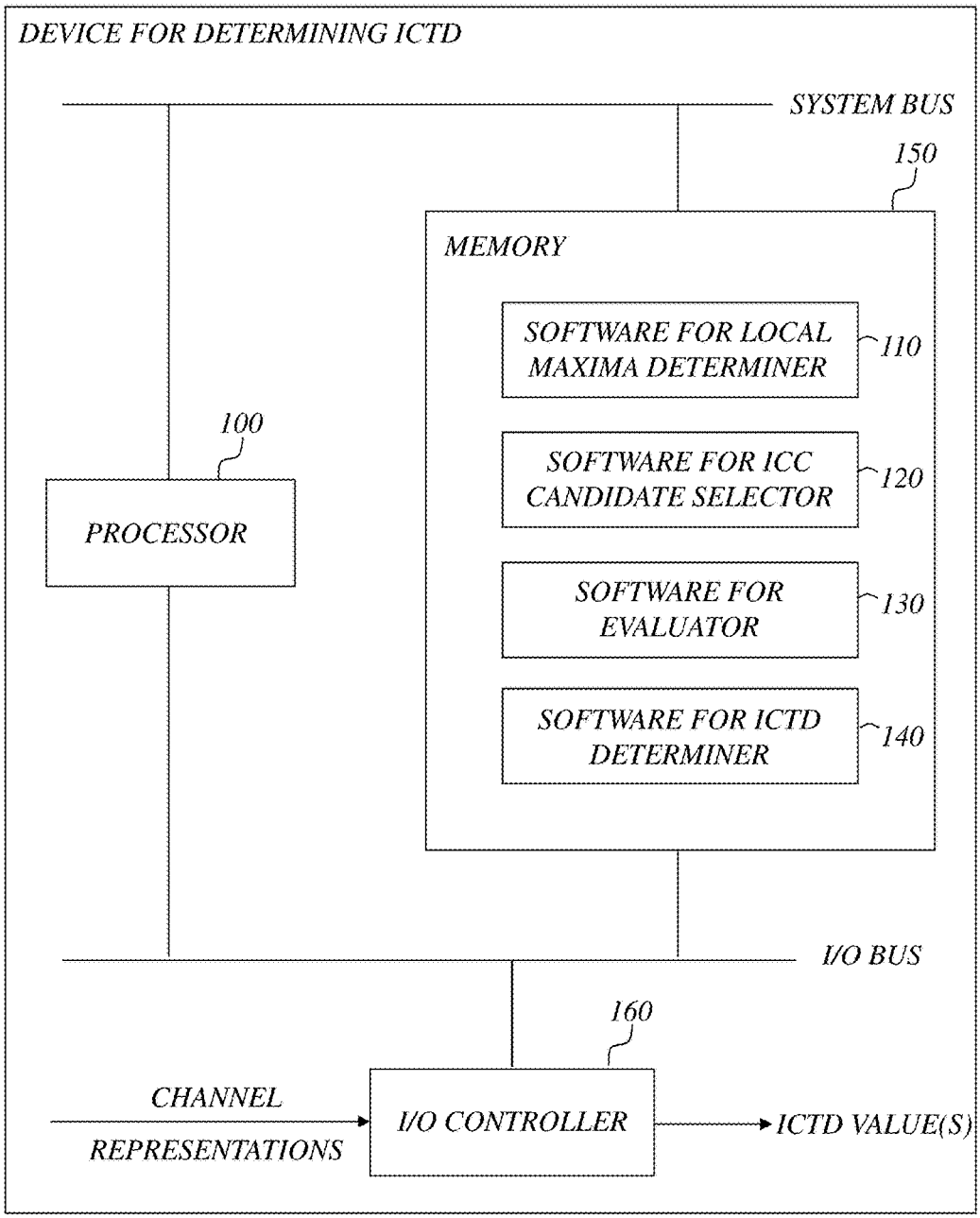
FIG. 15 is a schematic block diagram illustrating an example of a computer-implementation according to an embodiment.

In the following, an example of a computer-implementation will be described with reference to FIG. 15. This embodiment is based on a processor 100 such as a micro processor or digital signal processor, a memory 150 and an input/output (I/O) controller 160. In this particular example, at least some of the steps, functions and/or blocks described above are implemented in software, which is loaded into memory 150 for execution by the processor 100. The processor 100 and the memory 150 are interconnected to each other via a system bus to enable normal software execution. The I/O controller 160 may be interconnected to the processor 100 and/or memory 150 via an I/O bus to enable input and/or output of relevant data such as input parameter(s) and/or resulting output parameter(s).

In this particular example, the memory 150 includes a number of software components 110-140. The software component 110 implements a local maxima determiner corresponding to block 32 in the embodiments described above. The software component 120 implements an ICC candidate selector corresponding to block 34 in the embodiments described above. The software component 130 implements an evaluator corresponding to block 36 in the embodiments described above. The software component 140 implements an ICTD determiner corresponding to block 38 in the embodiments described above.

The I/O controller 160 is typically configured to receive channel representations of the multi-channel audio signal and transfer the received channel representations to the processor 100 and/or memory 150 for use as input during execution of the software. Alternatively, the input channel representations of the multi-channel audio signal may already be available in digital form in the memory 150.

The resulting ICTD value(s) may be transferred as output via the I/O controller 160. If there is additional software that needs the resulting ICTD value(s) as input, the ICTD value can be retrieved directly from memory.

Moreover, the present technology can additionally be considered to be embodied entirely within any form of computer-readable storage medium having stored therein an appropriate set of instructions for use by or in connection with an instruction-execution system, apparatus, or device, such as a computer-based system, processor-containing system, or other system that can fetch instructions from a medium and execute the instructions.

The software may be realized as a computer program product, which is normally carried on a non-transitory computer-readable medium, for example a CD, DVD, USB memory, hard drive or any other conventional memory device. The software may thus be loaded into the operating memory of a computer or equivalent processing system for execution by a processor. The computer/processor does not have to be dedicated to only execute the above-described steps, functions, procedure and/or blocks, but may also execute other software tasks.

The embodiments described above are to be understood as a few illustrative examples of the present technology. It will be understood by those skilled in the art that various modifications, combinations and changes may be made to the embodiments without departing from the scope of the present technology. In particular, different part solutions in the different embodiments can be combined in other configurations, where technically possible. The scope of the present technology is, however, defined by the appended claims.

REFERENCES

[1] C. Tournery, C. Faller, *Improved Time Delay Analysis/Synthesis for Parametric Stereo Audio Coding*, AES 120$^{th}$, Paris, 2006.

[2] D. Hyun et al., *Robust Interchannel Correlation (ICC) estimation using constant interchannel time difference (ICTD) compensation*, AES 127$^{th}$, New York, 2009.

ABBREVIATIONS

CCF Cross-Correlation Function
ITD Interaural Time Difference
ICTD Inter-Channel Time Difference
ILD Interaural Level Difference
ICLD Inter-Channel Level Difference
ICC Inter-Channel Coherence
IACC InterAural Cross-Correlation
DFT Discrete Fourier Transform
IDFT Inverse Discrete Fourier Transform
IFFT Inverse Fast Fourier Transform
DSP Digital Signal Processor
FPGA Field Programmable Gate Array
PLC Programmable Logic Controller

What is claimed is:

1. A method for determining an inter-channel time difference of a multi-channel audio signal having at least two channels, said method comprising:

determining a set of local maxima of a cross-correlation function involving at least two different channels of the multi-channel audio signal for positive and negative time-lags, where each local maximum is associated with a corresponding time-lag;

selecting, from the set of local maxima, a local maximum for positive time-lags as a positive time-lag inter-channel correlation candidate and a local maximum for negative time-lags as a negative time-lag inter-channel correlation candidate;

determining that the absolute value of a difference in amplitude between the inter-channel correlation candidates is smaller than a first threshold; and identifying the sign of the inter-channel time difference and extracting a current value of the inter-channel time difference based on either the time-lag corresponding to the positive time-lag inter-channel correlation candidate or the time-lag corresponding to the negative time-lag inter-channel correlation candidate.

2. The method of claim 1, further comprising determining whether there is a dominant channel.

3. The method of claim 2, wherein determining whether there is a dominant channel comprises determining whether there is a dominant channel based on information in or derived from the multi-channel audio signal, including at least one of an inter-channel level difference, a ratio between spectral peaks, and phase related information.

4. The method of claim 3, wherein the information indicating a dominant channel is used to identify the sign of the inter-channel time difference.

5. The method of claim 2, comprising comparing an absolute value of the inter-channel level difference with a second threshold, wherein, if the absolute value of the inter-channel level difference is larger than said second threshold, identifying the sign of the inter-channel time difference and extracting a current value of inter-channel time difference comprises:

selecting the inter-channel time difference as the time-lag corresponding to the positive time-lag inter-channel correlation candidate, if the inter-channel level difference is negative, and selecting the inter-channel time difference as the time-lag corresponding to the negative time-lag inter-channel correlation candidate, if the inter-channel level difference is positive.

6. The method of claim 2, comprising comparing an absolute value of the inter-channel level difference with a second threshold, wherein, if the absolute value of the inter-channel level difference is smaller than said second threshold, identifying the sign of the inter-channel time difference and extracting a current value of inter-channel time difference includes selecting, from the time-lags corresponding to the inter-channel correlation candidates, the time-lag that is closest to a previously determined inter-channel time difference.

7. The method of claim 1, wherein said selecting, from the set of local maxima, a local maximum for positive time-lags as a positive time-lag inter-channel correlation candidate and a local maximum for negative time-lags is selected as a negative time-lag inter-channel correlation candidate comprises:

identifying the positive time-lag inter-channel correlation candidate as the highest of the local maxima for positive time-lags; and identifying the negative time-lag inter-channel correlation candidate as the highest of the local maxima for negative time-lags.

8. The method of claim 1, wherein said selecting, from the set of local maxima, the local maximum for positive time-lags as the positive time-lag inter-channel correlation candidate and the local maximum for negative time-lags as the negative time-lag inter-channel correlation candidate comprises:

selecting several local maxima that are relatively close in amplitude to the global maximum as inter-channel correlation candidates, including local maxima for both positive and negative time-lags; and selecting, for positive time-lags, the inter-channel correlation candidate corresponding to the time-lag that is closest to a positive reference time-lag as the positive time-lag inter-channel correlation candidate; and selecting, for negative time-lags, the inter-channel correlation candidate corresponding to the time-lag that is closest to a negative reference time-lag as the negative time-lag inter-channel correlation candidate.

9. The method of claim 8, wherein the positive reference time-lag is selected as the last extracted positive inter-channel time difference, and the negative reference time-lag is selected as the last extracted negative inter-channel time difference.

10. A device for determining an inter-channel time difference of a multi-channel audio signal having at least two channels, wherein the device comprises processing circuitry is configured to:

determine a set of local maxima of a cross-correlation function involving at least two different channels of the multi-channel audio signal for positive and negative time-lags, where each local maximum is associated with a corresponding time-lag;

select, from the set of local maxima, a local maximum for positive time-lags as a positive time-lag inter-channel correlation candidate and a local maximum for negative time-lags as a negative time-lag inter-channel correlation candidate;

determine that the absolute value of a difference in amplitude between the inter-channel correlation candidates is smaller than a first threshold; and identify the sign of the inter-channel time difference and extract a current value of the inter-channel time difference based on either the time-lag corresponding to the positive time-lag inter-channel correlation candidate or the time-lag corresponding to the negative time-lag inter-channel correlation candidate.

11. The device of claim 10, wherein the processing circuitry is further configured to determine whether there is a dominant channel.

12. The device of claim 11, wherein the processing circuitry is configured to determine whether there is a dominant channel based on information in or derived from the multi-channel audio signal, including at least one of an inter-channel level difference, a ratio between spectral peaks, and phase related information.

13. The device of claim 12, wherein the processing circuitry is further configured to use the information used to determine whether there is a dominant channel, to identify the sign of the inter-channel time difference.

14. The device of claim 11, wherein the processing circuitry is further configured to compare an absolute value of the inter-channel level difference with a second threshold, and, if the absolute value of the inter-channel level difference is larger than said second threshold, identify the sign of the inter-channel time difference and extracts the current value of inter-channel time difference by, if the inter-channel level difference is negative, selecting the time-lag corresponding to the positive time-lag inter-channel correlation candidate, and, if the inter-channel level difference is positive, selecting the time-lag corresponding to the negative time-lag inter-channel correlation candidate.

15. The device of claim 11, wherein the processing circuitry is further configured to compare an absolute value of the inter-channel level difference with a second threshold, and, if the absolute value of the inter-channel level difference is smaller than said second threshold, identify the sign of the inter-channel time difference and extract the current value of inter-channel time difference by selecting, from the time-lags corresponding to the inter-channel correlation candidates, the time-lag that is closest to a previously determined inter-channel time difference.

16. The device of claim 10, wherein the processing circuitry is configured to select, from the set of local maxima, the local maximum for positive time-lags as the positive time-lag inter-channel correlation candidate and the local maximum for negative time-lags as the negative time-lag inter-channel correlation candidate, based on:

identifying the positive time-lag inter-channel correlation candidate as the highest of the local maxima for positive time-lags; and identifying the negative time-lag inter-channel correlation candidate as the highest of the local maxima for negative time-lags.

17. The device of claim 10, wherein, for selecting, from the set of local maxima, the local maximum for positive time-lags as the positive time-lag inter-channel correlation candidate and the local maximum for negative time-lags as the negative time-lag inter-channel correlation candidate, the processing circuitry is configured to:

select several local maxima that are relatively close in amplitude to the global maximum as inter-channel correlation candidates, including local maxima for both positive and negative time-lags; and select, for positive time-lags, the inter-channel correlation candidate corresponding to the time-lag that is closest to a positive reference time-lag as the positive time-lag inter-channel correlation candidate; and select, for negative time-lags, the inter-channel correlation candidate corresponding to the time-lag that is closest to a negative reference time-lag as the negative time-lag inter-channel correlation candidate.

18. The device of claim 17, wherein the processing circuitry is configured to select the positive reference time-lag as the last extracted positive inter-channel time difference, and select the negative reference time-lag as the last extracted negative inter-channel time difference.

19. An audio encoder comprising the device of claim 10.

20. A user equipment comprising the device of claim 10.

21. The user equipment of claim 20, wherein the user equipment is one of: a mobile telephone, a pager, a headset, a laptop computer and a mobile terminal.

* * * * *